US012006110B2

(12) United States Patent
Bois

(10) Patent No.: US 12,006,110 B2
(45) Date of Patent: Jun. 11, 2024

(54) TAMPER-EVIDENT CLOSURE

(71) Applicant: AIRNOV, INC., New Castle, DE (US)

(72) Inventor: Dominique Bois, Montreuil aux Lions (FR)

(73) Assignee: AIRNOV, INC., New Castle, DE (US)

( * ) Notice: Subject to any disclaimer, the term of this patent is extended or adjusted under 35 U.S.C. 154(b) by 0 days.

(21) Appl. No.: 18/258,307

(22) PCT Filed: Dec. 17, 2021

(86) PCT No.: PCT/EP2021/086545
§ 371 (c)(1),
(2) Date: Jun. 19, 2023

(87) PCT Pub. No.: WO2022/129553
PCT Pub. Date: Jun. 23, 2022

(65) Prior Publication Data

US 2023/0406582 A1 Dec. 21, 2023

(30) Foreign Application Priority Data

Dec. 18, 2020 (EP) ..... 20215494

(51) Int. Cl.
*B65D 50/00* (2006.01)
*B65D 41/00* (2006.01)
(Continued)

(52) U.S. Cl.
CPC ..... *B65D 50/041* (2013.01); *B65D 41/005* (2013.01); *B65D 55/022* (2013.01); *B65D 2401/20* (2020.05)

(58) Field of Classification Search
CPC ..... B65D 41/005; B65D 41/3428; B65D 41/3433; B65D 41/3438; B65D 50/041;
(Continued)

(56) References Cited

U.S. PATENT DOCUMENTS 2,054,032 A * 9/1936 Conner ..... B65D 55/022 215/252
2,054,034 A * 9/1936 Conner ..... B65D 55/022 215/253
(Continued)

FOREIGN PATENT DOCUMENTS

WO 98/51758 A1 11/1998
WO 99/28205 A1 6/1999
(Continued)

OTHER PUBLICATIONS

International Search Report with Written Opinion of the International Searching Authority, dated Mar. 21, 2022, with respect to International Application No. PCT/EP2021/086545.

*Primary Examiner* — Gideon R Weinerth
(74) *Attorney, Agent, or Firm* — Scott R. Cox

(57) ABSTRACT

A tamper-evident closure containing an outer cap with a sidewall and a top wall having a tamper-evident member connected by a frangible structure; an inner cap with a sidewall and a top wall, coaxially nested in the outer cap; a protruding element between the top walls; a first engagement mechanism for driving the outer cap and the inner cap upon application of a rotational torque in a screwing direction; a second engagement mechanism for driving the outer cap and the inner cap upon application of a rotational torque in an unscrewing direction; and a third engagement mechanism for breaking the frangible structure upon rotational movement of the outer and inner caps.

20 Claims, 11 Drawing Sheets

(51) Int. Cl.
*B65D 50/04* (2006.01)
*B65D 55/02* (2006.01)

(58) Field of Classification Search
CPC ..... B65D 55/022; B65D 2215/02; B65D 2215/04; B65D 2401/20; B65D 55/024; A61J 1/1412; B65B 5/04
USPC ..... 215/201, 204, 219, 220, 252, 342, 250
See application file for complete search history.

(56) References Cited

U.S. PATENT DOCUMENTS 2,560,793 A * 7/1951 Greene ..... B65D 55/022 215/252
3,372,825 A * 3/1968 Laviano ..... B65D 50/041 215/206
3,650,426 A * 3/1972 Miller ..... B65D 50/041 215/220
3,705,662 A * 12/1972 Gach ..... B65D 50/041 215/220
3,716,161 A * 2/1973 Julian ..... B65D 41/06 D9/454
3,776,407 A * 12/1973 Cistone ..... B65D 50/041 215/301
3,795,337 A * 3/1974 Nozawa ..... B65D 50/041 215/301
3,809,272 A * 5/1974 Maki ..... B65D 50/041 215/219
3,830,390 A * 8/1974 Gach ..... B65D 50/041 215/220
3,843,006 A * 10/1974 Naito ..... B65D 50/041 215/220
3,857,505 A * 12/1974 Mumford ..... B65D 50/041 215/220
3,918,602 A * 11/1975 McIntosh ..... B65D 50/041 215/219
4,319,690 A * 3/1982 Birrell ..... B65D 50/041 215/220
4,378,894 A * 4/1983 Willis ..... B65D 55/066 215/250
4,454,955 A * 6/1984 Kusz ..... B65D 55/089 215/220
4,523,688 A * 6/1985 Puresevic ..... B65D 50/041 215/220
4,527,701 A * 7/1985 Schaubeck ..... B65D 50/041 215/220
4,570,809 A * 2/1986 Archer ..... B65D 50/041 215/256
4,632,264 A * 12/1986 Evans ..... B65D 50/041 215/220
4,669,620 A * 6/1987 Coifman ..... B65D 55/024 215/220
4,673,095 A * 6/1987 Puresevic ..... B65D 50/041 215/220
4,801,028 A * 1/1989 Puresevic ..... B65D 50/041 215/220
4,832,218 A * 5/1989 Gibilisco ..... B65D 50/041 215/221
5,020,681 A * 6/1991 Kusz ..... B65D 50/041 215/220
5,316,161 A * 5/1994 Gargione ..... B65D 50/041 215/220
5,381,917 A * 1/1995 Santagiuliana ..... B65D 50/041 220/220
5,667,085 A * 9/1997 Ogden ..... B65D 50/041 215/253
5,736,616 A 4/1998 Ching et al.
5,762,215 A * 6/1998 Ogden ..... B65D 50/041 215/217
5,785,194 A * 7/1998 Ogden ..... B65D 50/041 220/284
5,819,969 A * 10/1998 Kalodye ..... B65D 55/024 215/901
6,029,834 A * 2/2000 Sanner ..... B65D 50/041 215/220
6,085,920 A * 7/2000 Moretti ..... B65D 41/34 215/277
8,302,792 B2 11/2012 Logel et al.
8,316,622 B2 * 11/2012 Jajoo ..... B65D 50/041
8,474,634 B1 * 7/2013 Branson ..... B65D 50/041 215/230
9,586,738 B2 3/2017 Herrbach et al.
9,650,184 B2 5/2017 Fily et al.
10,081,460 B2 * 9/2018 Painchaud ..... B05B 11/0032
10,202,224 B2 * 2/2019 Painchaud ..... B65D 51/228
10,220,989 B2 * 3/2019 Painchaud ..... B65D 47/2081
11,299,330 B2 * 4/2022 Lebon ..... B65D 51/244
11,760,545 B1 * 9/2023 Wade ..... B65D 51/223 215/238
2004/0099627 A1 * 5/2004 Yan ..... B65D 50/041 215/220
2005/0150857 A1 * 7/2005 Brozell ..... B65D 50/041 215/220
2005/0161425 A1 * 7/2005 Morini ..... B65D 41/3428 215/220
2010/0237072 A1 * 9/2010 Ahn ..... B65D 50/041 220/254.8
2010/0288765 A1 * 11/2010 Herrbach ..... B65D 50/041 220/212
2012/0138561 A1 * 6/2012 Brozell ..... B65D 50/041 215/220
2018/0099797 A1 * 4/2018 Biesecker Longacre ..... B65D 51/18
2019/0263569 A1 * 8/2019 Smith ..... B65D 41/3433
2019/0344938 A1 * 11/2019 Lebon ..... B65D 41/0414
2021/0171249 A1 * 6/2021 Aboabdo ..... B65D 1/0246
2021/0179323 A1 * 6/2021 Kreinbrink ..... B65D 41/3428
2023/0242306 A1 * 8/2023 Robison ..... B65D 50/041 215/219
2023/0312194 A1 * 10/2023 Dhawan ..... B65D 50/041 215/217
2023/0406582 A1 * 12/2023 Bois ..... B65D 41/005

FOREIGN PATENT DOCUMENTS

WO 99/48963 A2 9/1999
WO 2017/220729 A1 12/2017
WO 2018/149778 A1 8/2018

* cited by examiner

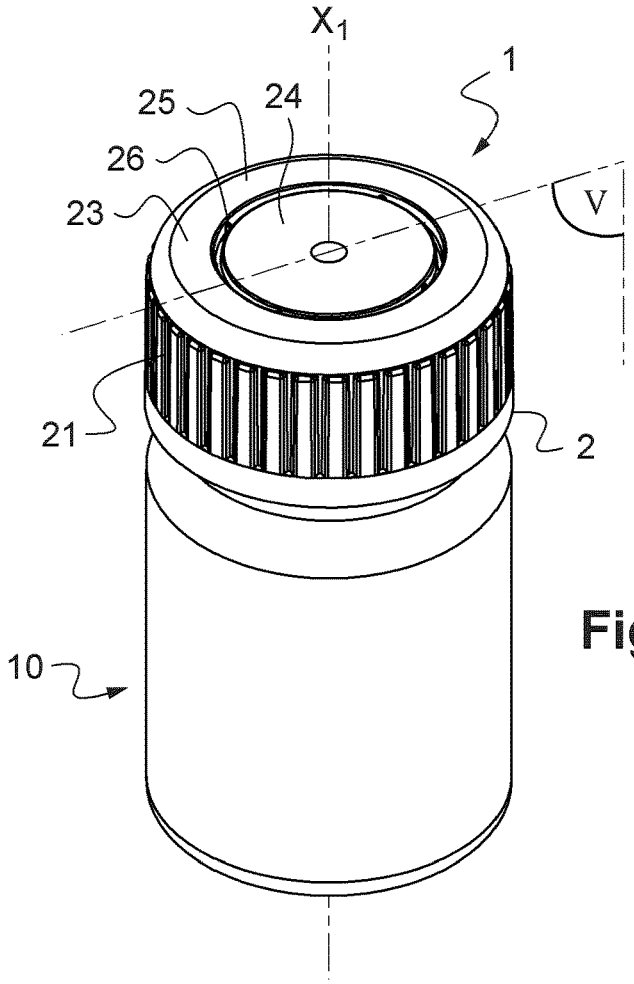
Fig.1
Fig.2
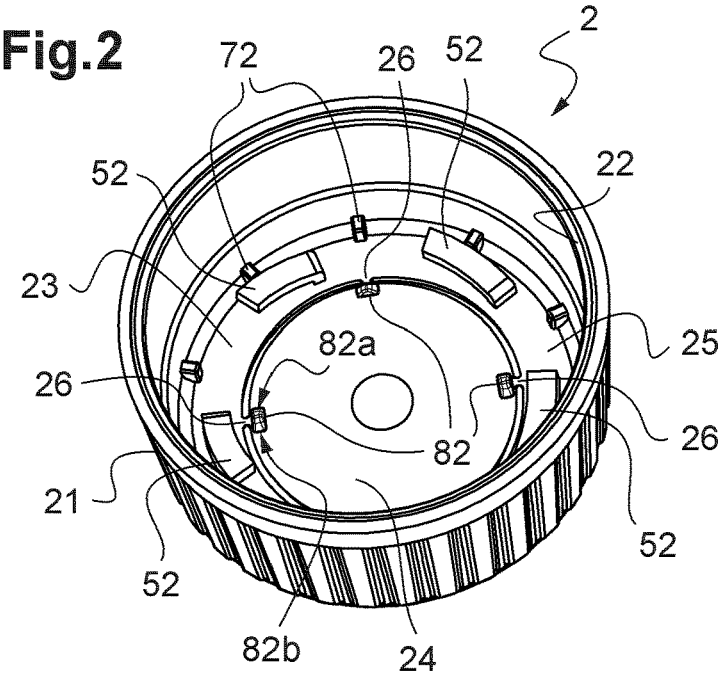

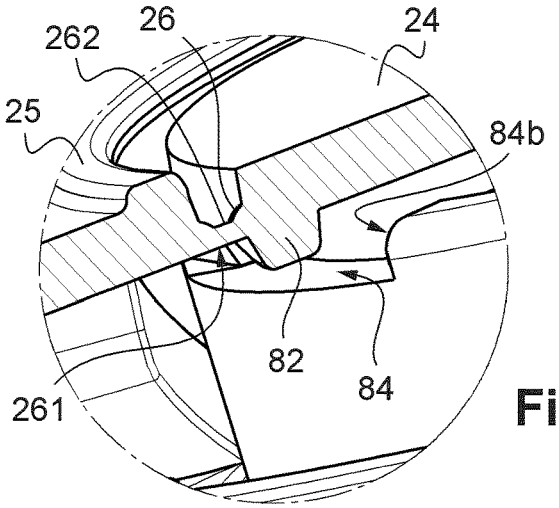
Fig.7
Fig.8
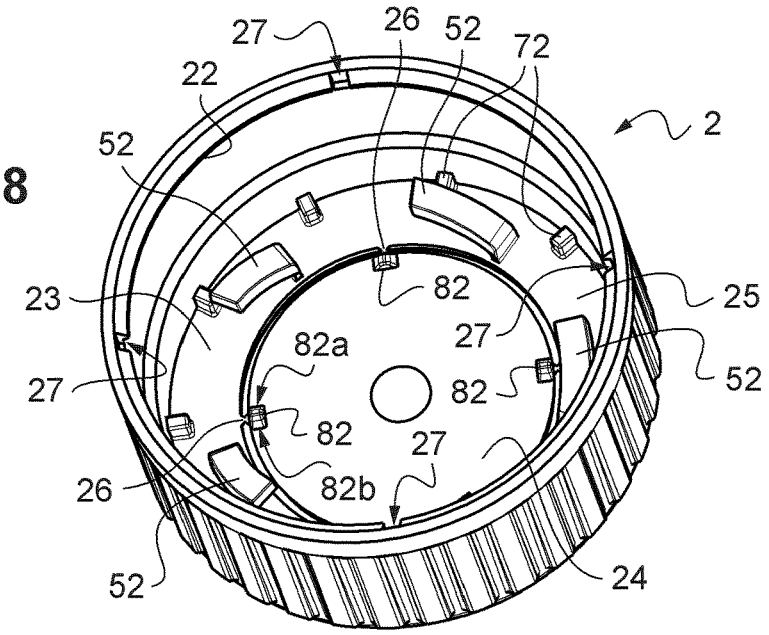
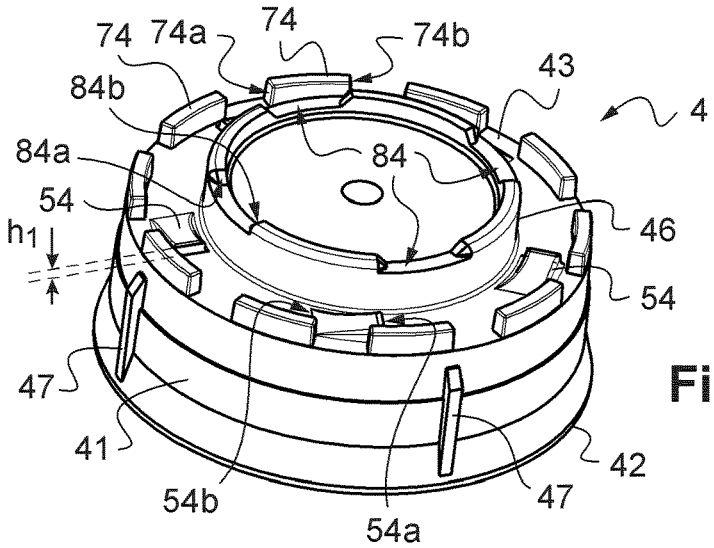
Fig.9

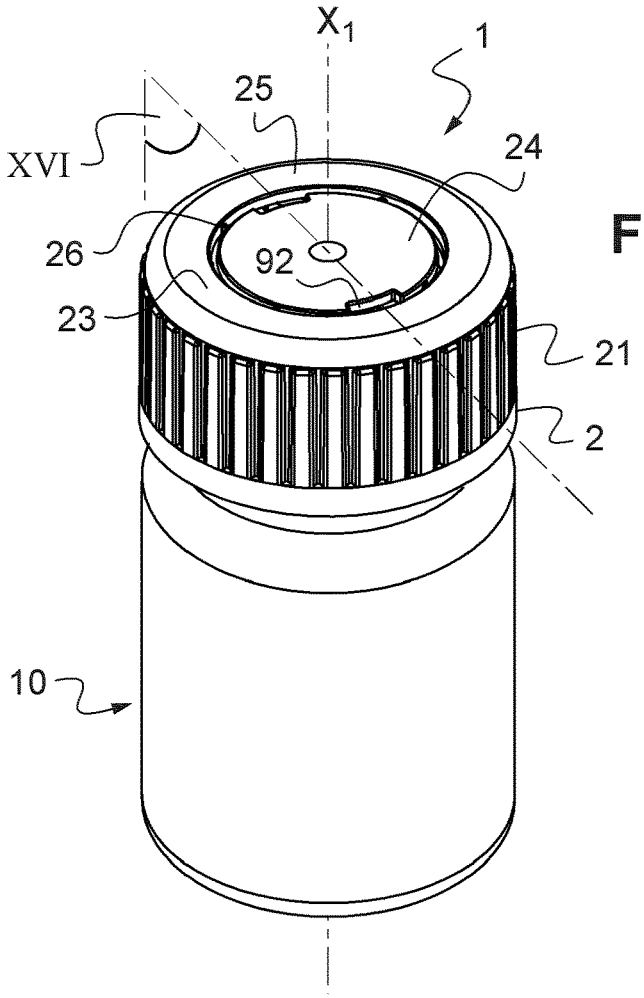
Fig.12
Fig.13
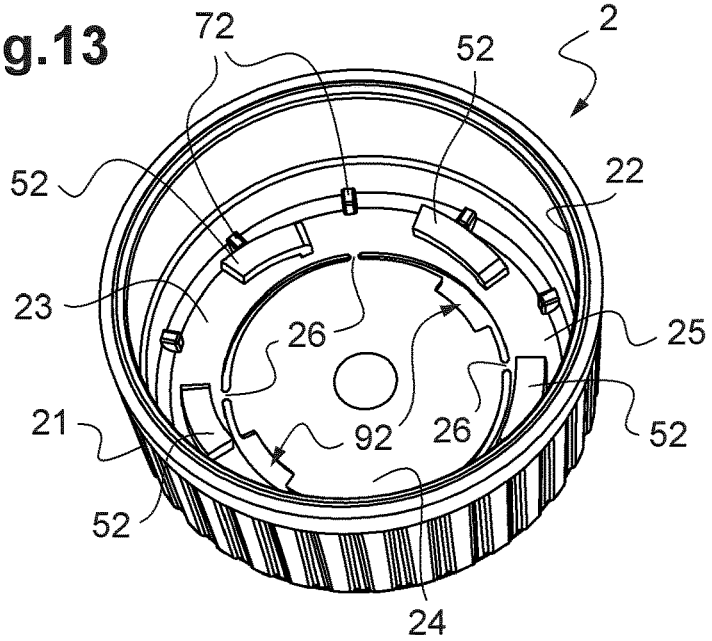

X1
R2
R1
1
XVII
XVII
F
F
52
92
23
46
92
94
26
25
54
72
74
94
24
52
hm
h0
43
21
41
48
49
16
12
41'
14
4
44
2
42
45
45'
15
40
22
10

R1
R2
52
54
54b
52
XVI
1
54
26
92
94
21
54a
26
54
26
72
94b
74a
52
92b
54
74
92
92a
2
26
α2
4
74b
94
α4
α1
52
XVI
94a
α3

TAMPER-EVIDENT CLOSURE

FIELD OF THE INVENTION

The present invention relates to a tamper-evident closure for a container having a threaded opening. The invention also relates to a container with a tamper-evident closure and to a specific use thereof.

BACKGROUND OF THE INVENTION

Tamper-evident closures are often used for containers holding pharmaceutical substances. One safety feature of such closures, which may be combined with child-resistant features, is to allow detection of whether the closure has already been opened before. For this purpose, tamper-evident indicators are commonly used. For screw caps, the most common tamper-evident indicator is a ring surrounding the lower end of the cap, which is connected to the cap by means of a plurality of frangible bridges. When opening the closure for the first time, the frangible bridges are broken, thus disconnecting the tamper-evident ring from the cap. However, such solution requires an adapted container with protruding parts or a peripheral groove close to the threaded neck. Another solution for providing a tamper-evident function involves welding a foil on the upper surface of the opening of the container. However, with such a solution, it is no longer possible to integrate a chamber in the closure to receive an active material intended to control the atmosphere within the container.

WO2017/220729A1 discloses a closure comprising a tamper-evident system, a child-resistant mechanism and a desiccant chamber integrated in the closure. The closure comprises an outer cap and an inner cap capable of relative axial movement. When the closure is mounted on a container, the application on the outer cap of a combination of an axial force and a rotational torque in a direction of unscrewing makes it possible both to break a tamper-evident member of the outer cap, thus indicating that the closure has been opened, and to bring cooperation means into engagement between the outer cap and the inner cap, so that the inner cap can be rotated by the outer cap and the closure can be removed from the container.

There is still a need to secure the tamper-evident system of such a closure, in order to prevent any fraudulent opening of the closure without breaking the tamper-evident system.

DISCLOSURE OF THE INVENTION

For this purpose, a subject of the invention is a tamper-evident closure for a container having an opening with a thread, the closure comprising:

- an outer cap with a first sidewall and a first top wall, the first top wall comprising a tamper-evident member connected to a surrounding region by a frangible structure;
- an inner cap with a second sidewall and a second top wall, the inner cap comprising a cap thread configured to cooperate with the container thread, the inner cap being coaxially nested in the outer cap with possibility of relative axial movement so that the first and second top walls can be displaced relative to each other in the direction of a main axis of the closure;
- at least one protruding element arranged between the first top wall and the second top wall, while facing the tamper-evident member;

- a first engagement mechanism between the outer cap and the inner cap, configured to drive the outer cap and the inner cap in unison in a direction of screwing the cap thread onto the container thread, upon application on the outer cap of a rotational torque in the direction of screwing, so as to mount the closure on the container without breaking the frangible structure;
- a second engagement mechanism between the outer cap and the inner cap, configured to drive the outer cap and the inner cap in unison in a direction of unscrewing the cap thread relative to the container thread, upon application on the outer cap of a rotational torque in the direction of unscrewing at the same time as an axial force in the direction of the main axis, so as to remove the closure from the container;
- wherein the closure further comprises a third engagement mechanism between the outer cap and the inner cap, configured to break the frangible structure upon relative rotational movement of the outer and inner caps when the outer cap is rotated in the direction of unscrewing, regardless of an axial force applied on the outer cap in the direction of the main axis.

Thanks to its specific structure, the tamper-evident closure according to the invention guarantees that the tamper-evident member is detached not only when the closure is opened normally, i.e. using the child-resistant second engagement mechanism to secure the outer cap and the inner cap together in rotation, but also when the closure is opened fraudulently, without securing the outer cap and the inner cap together in rotation. More specifically, the third engagement mechanism ensures that a relative rotational movement of the outer and inner caps, in particular resulting from a fraudulent attempt to open the closure without using the second engagement mechanism, leads to a rupture of the frangible structure.

In practice, when the closure is opened using the child-resistant second engagement mechanism, by simultaneous application on the outer cap of a rotational torque in the direction of unscrewing plus an axial force in the direction of the main axis, the frangible structure is broken by the protruding element(s) which comes in abutting contact with the tamper-evident member due to the axial displacement of the first and second top walls toward each other. It is noted that, within the frame of the invention, the protruding element(s), arranged between the first top wall and the second top wall, may be secured to either one of the outer cap and the inner cap.

Advantageously, for the initial mounting of the closure on a container without breaking the frangible structure, the first engagement mechanism is configured to drive the outer cap and the inner cap in unison in the direction of screwing when a user applies on the outer cap a rotational torque in the direction of screwing, even without applying on the outer cap an axial force in the direction of the main axis of the closure. Such a configuration makes it possible to avoid bringing the protruding element(s) in abutting contact against the tamper-evident member in the direction of the main axis of the closure, thus preserving the integrity of the frangible structure during the initial mounting of the closure on a container.

According to one feature of the invention, the second engagement mechanism comprises coupling elements which are brought in mutual engagement, under the effect of the axial force in the direction of the main axis, against an elastic action of at least one elastic element of the closure, in such a way that the coupling elements of the second engagement mechanism are automatically disengaged when the axial force is released.

Advantageously, the at least one elastic element is configured to remain active for automatically disengaging the coupling elements of the second engagement mechanism when the frangible structure is broken. In other words, the child-resistance of the second engagement mechanism, which is a "push and turn" mechanism, is preserved even when the tamper-evident member is detached.

According to one embodiment, the closure comprises at least one elastic member provided between the outer cap and the inner cap, for biasing the first and second top walls away from each other in the direction of the main axis of the closure, the coupling elements of the second engagement mechanism being brought in mutual engagement against the elastic action of the at least one elastic member. In one embodiment, the elastic biasing is provided by elastic members also forming coupling elements of at least one engagement mechanism of the closure, e.g. the first engagement mechanism. As a variant, the elastic biasing may be provided by a dedicated spring member, which is independent from the engagement mechanisms of the closure.

According to one embodiment, the outer cap is elastically deformable, the coupling elements of the second engagement mechanism being brought in mutual engagement through a reversible elastic deformation of the outer cap. In particular, the engagement of the coupling elements of the second engagement mechanism may result from an elastic deformation of the outer cap under the effect of an axial force applied in the direction of the main axis of the closure and, when the axial force is released, the outer cap may elastically return to its initial configuration, thus automatically disengaging the coupling elements of the second engagement mechanism.

According to one feature of the invention, the third engagement mechanism is separate and distinct from any of the first engagement mechanism and the second engagement mechanism. In other words, the coupling elements of the third engagement mechanism are distinct from the coupling elements of the first engagement mechanism and the second engagement mechanism, it being understood that the coupling elements of the first engagement mechanism and the coupling elements of the second engagement mechanism may themselves be either formed by the same elements or by distinct elements.

According to one embodiment, the third engagement mechanism is configured to break the frangible structure, upon relative rotational movement of the outer and inner caps, both when the outer cap is rotated in the direction of unscrewing and when the outer cap is rotated in the direction of screwing, regardless of an axial force applied on the outer cap in the direction of the main axis. In this way, the third engagement mechanism ensures that a relative rotational movement of the outer and inner caps, in any rotational direction, leads to a rupture of the frangible structure.

According to one feature of the invention, the third engagement mechanism comprises a first coupling element on the tamper-evident member and a second coupling element on the inner cap, the first coupling element having an engaging edge configured to cooperate with a corresponding engaging edge of the second coupling element, upon relative rotational movement of the outer and inner caps when the outer cap is rotated in the direction of unscrewing.

According to one embodiment, the engaging edge of the second coupling element provided on the inner cap is an inclined edge, on which the first coupling element provided on the tamper-evident member is configured to move away from the surrounding region in the direction of the main axis of the closure, upon relative rotational movement of the outer and inner caps when the outer cap is rotated in the direction of unscrewing, so that the frangible structure is broken under the effect of an axial stretching stress applied to it.

More specifically, in this embodiment, the first coupling element arranged on the tamper-evident member is raised away from the surrounding region in the direction of the main axis of the closure, while traveling on the inclined edge of the second coupling element, which results in an axial displacement of the tamper-evident member away from the surrounding region, thus rupturing the frangible structure. This embodiment is advantageous in that the mode of rupture of the frangible structure is the same whether it is broken due to the abutting contact of the protruding element(s) or due to the cooperation of the coupling elements of the third engagement mechanism. In both cases, the rupture of the frangible structure results from an axial stretching stress applied on the frangible structure in the direction of the main axis of the closure.

According to another embodiment, the engaging edge of the second coupling element provided on the inner cap is a substantially straight edge, against which the first coupling element provided on the tamper-evident member is configured to press circumferentially, upon relative rotational movement of the outer and inner caps when the outer cap is rotated in the direction of unscrewing, so that the frangible structure is broken under the effect of a circumferential shear stress applied on it.

More specifically, in this embodiment, the first coupling element arranged on the tamper-evident member is pressed against the engaging edge of the second coupling element, so that the tamper-evident member tends to be displaced circumferentially relative to the surrounding region, resulting in shear stress being applied to the frangible structure. In this embodiment, the frangible structure is designed to be broken according to two different modes of rupture: under the effect of an axial stretching stress applied to it, when it is broken due to the abutting contact of the protruding element(s); and under the effect of a circumferential shear stress applied to it, when it is broken due to the cooperation of the coupling elements of the third engagement mechanism.

According to one feature of the invention, each pair of coupling elements of the third engagement mechanism comprises a male coupling element and a female coupling element, the male coupling element being received in the female coupling element with possibility of axial displacement of the male and female coupling elements toward each other in the direction of the main axis of the closure, starting from an initial mounting configuration of the closure. Throughout this text, the expression "the initial mounting configuration of the closure" refers to a configuration of the closure suitable for the initial mounting of the closure on a container, which in practice advantageously corresponds to the configuration in which the inner cap is initially assembled with the outer cap.

According to one embodiment, at least one pair of coupling elements of the third engagement mechanism comprises a male coupling element arranged on the tamper-evident member and a female coupling element arranged on the inner cap. According to one embodiment, at least one pair of coupling elements of the third engagement mechanism comprises a male coupling element arranged on the inner cap and a female coupling element arranged on the tamper-evident member. Both male and female coupling elements may be provided on one among the tamper-evident member and the inner cap, with the corresponding female and male coupling elements on the other one among the tamper-evident member and the inner cap.

In one embodiment, the coupling elements of the first engagement mechanism comprise a plurality of elastic elements in the shape of inclined strips and a plurality of wedge-shaped elements, so that, when a rotational torque in the direction of screwing is applied on the outer cap, the elastic elements come into a locking arrangement with a higher edge of the wedge-shaped elements and the inner cap is rotated in unison with the outer cap in the direction of screwing.

In one embodiment, the coupling elements of the first engagement mechanism comprise a plurality of driving ribs and a plurality of wedge-shaped elements, so that, when a rotational torque in the direction of screwing is applied on the outer cap, the driving ribs come into a locking arrangement with a higher edge of the wedge-shaped elements and the inner cap is rotated in unison with the outer cap in the direction of screwing.

In one embodiment, the coupling elements of the second engagement mechanism comprise the same coupling elements as the first engagement mechanism, in the form of driving ribs and wedge-shaped elements, so that, when a combination of an axial force in the direction of the main axis and a rotational torque in the direction of unscrewing is applied on the outer cap, the driving ribs come into a locking arrangement with a lower edge of the wedge-shaped elements and the inner cap is rotated in unison with the outer cap in the direction of unscrewing.

According to one embodiment, the frangible structure comprises a plurality of frangible bridges, each coupling element of the third engagement mechanism arranged on the tamper-evident member being positioned in the vicinity of a frangible bridge. For example, in one illustrative embodiment, the frangible structure comprises four frangible bridges, and the tamper-evident member comprises four male coupling elements each positioned in the vicinity of a respective frangible bridge.

According to one feature of the invention, in the initial mounting configuration of the closure, the angular stroke, in the direction of screwing, for engagement of the coupling elements of the first engagement mechanism is less than or equal to, preferably less than, the angular stroke, in the direction of screwing, for engagement of the coupling elements of the third engagement mechanism. Such a configuration ensures that the closure can be mounted on the container without breaking the frangible structure.

In the initial mounting configuration of the closure, the coupling elements of the first engagement mechanism may be positioned in abutment against each other in pairs in the direction of screwing, which corresponds to an angular stroke substantially equal to zero in the direction of screwing for engagement of the coupling elements of the first engagement mechanism. As a variant, in the initial mounting configuration of the closure, there may be an initial gap for each pair of coupling elements of the first engagement mechanism. Then, the width of the initial gap between the coupling elements of the first engagement mechanism is selected to be less than or equal to, preferably less than, the width of a gap existing between the coupling elements of the third engagement mechanism, all gaps being considered in the direction of screwing.

According to one feature of the invention, in the initial mounting configuration of the closure, the angular stroke for engagement of the coupling elements of the third engagement mechanism in the direction of unscrewing is substantially equal to the angular stroke for engagement of the coupling elements of the third engagement mechanism in the direction of screwing. In this way, starting from the initial mounting configuration of the closure, the efficiency of the third engagement mechanism in breaking the frangible structure, upon relative rotational movement of the outer cap and the inner cap, is substantially the same in any rotational direction among the direction of screwing and the direction of unscrewing.

According to one feature of the invention, the axial clearance of the closure in the direction of the main axis, corresponding to the axial displacement of the outer cap toward the inner cap between the initial mounting configuration of the closure and the configuration of the closure where the coupling elements of the second engagement mechanism start to be in mutual engagement, is higher than or equal to, preferably higher than, the axial displacement needed for the protruding element(s) to come into abutting contact with the tamper-evident member and break the frangible structure. In this way, when the coupling elements of the second engagement mechanism are in mutual engagement, the tamper-evident member has necessarily been detached from the surrounding region through rupture of the frangible structure under the pressure exerted by the protruding element(s).

According to one feature of the invention, the closure comprises an indexing mechanism for positioning the outer cap and the inner cap in the initial mounting configuration of the closure. In one embodiment, the indexing mechanism comprises complementary structures in relief on the outer cap and the inner cap, adapted to guide the outer cap and the inner cap toward the initial mounting configuration of the closure while leaving the outer cap and the inner cap freely rotatable relative to each other in the initial mounting configuration of the closure. In particular, the indexing mechanism may comprise at least one indexing rib provided on one among the outer cap and the inner cap, and configured to cooperate with a complementary indexing groove provided on the other one among the outer cap and the inner cap. Preferably, the indexing mechanism comprises a plurality of complementary structures in relief, e.g. a plurality of indexing ribs and grooves, which are distributed around the periphery of the outer and inner caps, so as to control the relative position of the caps over their entire circumference during their assembly.

It is noted that, instead of an indexing mechanism involving a mechanical guiding, the outer cap and the inner cap may be positioned in the initial mounting configuration of the closure using other types of indexing means, for example using a visual inspection system comprising a camera for angularly pre-positioning the inner cap relative to the outer cap around the main axis of the closure before the inner cap is nested in the outer cap.

According to one embodiment, the closure comprises a locking mechanism for retaining the inner cap within the outer cap. In particular, the locking mechanism may comprise an inner bead of the outer cap designed to cooperate with a corresponding outer flange of the inner cap.

According to one embodiment, the inner cap defines a cavity for receiving an active material. Within the meaning of the invention, an active material is a material capable of regulating the atmosphere in the container. The active material may be any type of active material. In particular, the active material may belong to a group of: humidity absorbers (or desiccants); oxygen scavengers; odor absorbers;

and/or emitters of humidity or volatile olfactory organic compounds. Optionally, the active material may be capable of releasing gaseous substances such as moisture or perfume. Such properties can for example be useful for applications where sensitive products require a certain humidity level. Such products are, for example, powders, especially for generating aerosols, gelatin capsules, herbal medicine, gels and creams including cosmetics, and food products.

Examples of suitable dehydrating agents include, without limitation, silica gels, dehydrating clays, activated alumina, calcium oxide, barium oxide, natural or synthetic zeolites, molecular or similar sieves, or deliquescent salts such as magnesium sulfide, calcium chloride, aluminum chloride, lithium chloride, calcium bromide, zinc chloride or the like. Preferably, the dehydrating agent is a molecular sieve and/or a silica gel.

Examples of suitable oxygen collecting agents include, without limitation, metal powders having a reducing capacity, in particular iron, zinc, tin powders, metal oxides still having the ability to oxidize, in particular ferrous oxide, as well as compounds of iron such as carbides, carbonyls, hydroxides, used alone or in the presence of an activator such as hydroxides, carbonates, sulfites, thiosulfates, phosphates, organic acid salts, or hydrogen salts of alkaline metals or alkaline earth metals, activated carbon, activated alumina or activated clays. Other agents for collecting oxygen can also be chosen from specific reactive polymers such as those described for example in the patent documents U.S. Pat. No. 5,736,616A, WO99/48963A2, WO98/51758A1 and WO2018/149778A1.

According to one embodiment, the inner cap comprises a sealing member configured to provide a hermetic seal between the inner cap and the opening of the container, the sealing member being preferably an inner sealing skirt with a slanted sealing surface.

Another subject of the invention is a container with a closure as described above, the closure being fixedly screwed onto a thread of the container and closing same.

Another subject of the invention is a use of a container as described above for containing moisture-sensitive items, such as tablets or capsules containing a pharmaceutical composition; nutraceuticals; herbalism products; diagnostic products.

BRIEF DESCRIPTION OF THE DRAWINGS

Features and advantages of the invention will become apparent from the following description of four embodiments of a tamper-evident closure and a container according to the invention, this description being given merely by way of example and with reference to the appended drawings in which:

FIG. 1 is a perspective view of a container with a tamper-evident closure according to a first embodiment of the invention;

FIG. 2 is a perspective bottom view of the outer cap of the tamper-evident closure of FIG. 1;

FIG. 7 is a perspective view, at larger scale and with partial cutaway, of a part of the tamper-evident closure of FIG. 1;

FIG. 8 is a perspective bottom view similar to FIG. 2 of the outer cap of a tamper-evident closure according to a second embodiment of the invention;

FIG. 9 is a perspective top view similar to FIG. 3 of the inner cap of the tamper-evident closure according to the second embodiment;

FIG. 12 is a perspective view of a container with a tamper-evident closure according to a third embodiment of the invention;

FIG. 13 is a perspective bottom view of the outer cap of the tamper-evident closure of FIG. 12;

ILLUSTRATIVE EMBODIMENTS OF THE INVENTION

Figure 3:
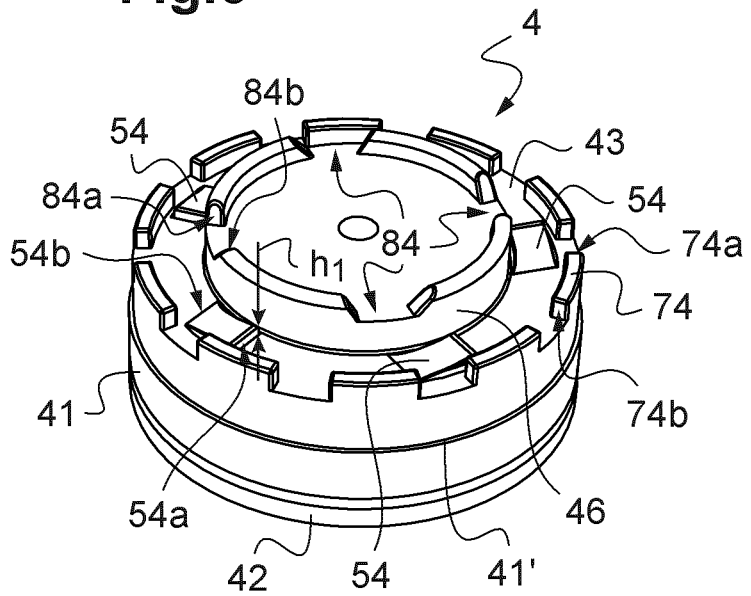
FIG. 3 is a perspective top view of the inner cap of the tamper-evident closure of FIG. 1.
Figure 4:
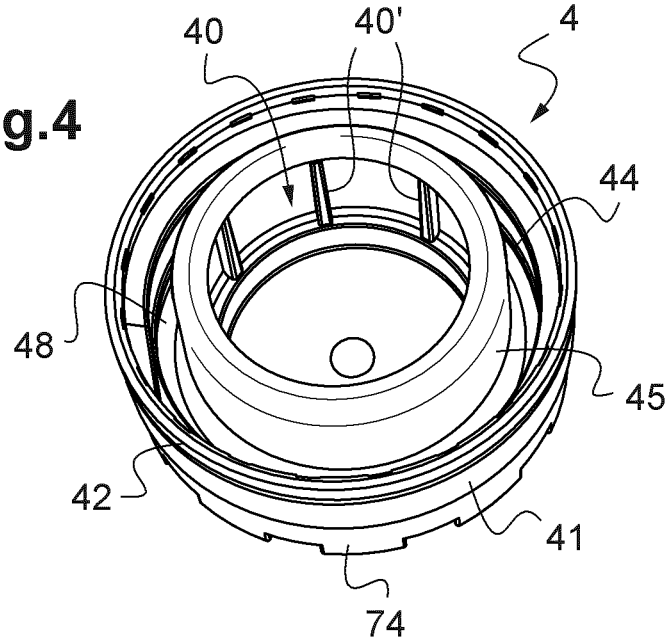
FIG. 4 is a perspective bottom view of the inner cap of the tamper-evident closure of FIG. 1.
Figure 5:
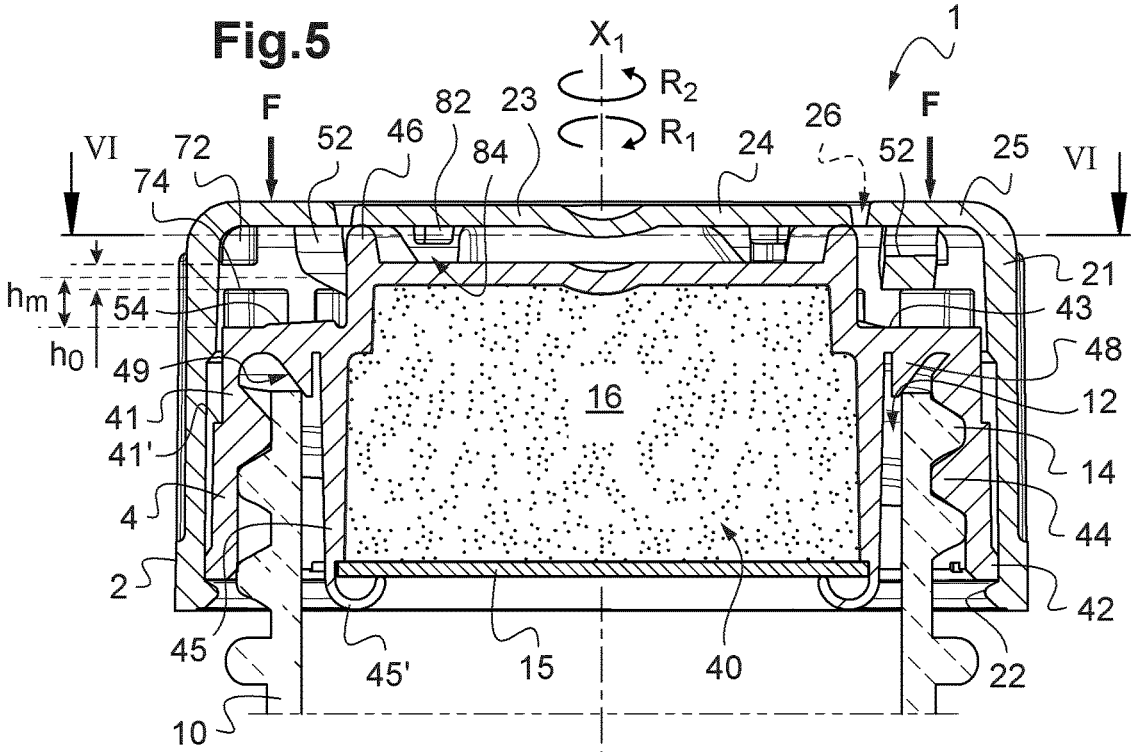
FIG. 5 is a cross section at larger scale according to plane V of FIG. 1.

In the first embodiment shown in FIGS. 1 to 7, the tamper-evident closure 1 according to the invention is configured to be screwed onto a container 10 which, as visible in FIG. 5, has an opening 12 provided with an external thread 14. The shape of the container 10 shown in the figures only serves as an example, it being understood that the container 10 can have any shape, as long as it is provided with an opening surrounded, either externally as shown in the figures, or else internally, by a thread 14 on which the closure 1 can be screwed. In the example of FIG. 1, the container is provided with a neck portion. However, it is also possible to provide the container in the shape of a bottle with a relatively narrow neck, or in the shape of a straight cylinder. Likewise, it is possible to provide non-rotational geometries for the container, as long as it is provided with an annular container thread, which may be a continuous thread or an interrupted thread.

The closure 1 comprises two caps which are nested inside each other. In FIG. 1, only the outer cap 2 is visible, which comprises a first sidewall 21 and a first top wall 23. The first sidewall 21 can be provided with suitable means to increase the grip for a user. In the example shown, a plurality of ribs are provided on the first sidewall 21, extending axially in the direction of a main axis $X_1$ of the closure. The first top wall 23 comprises a tamper-evident member 24, which is connected to a surrounding region 25 by a frangible structure 26. By way of a non-limiting example, in the illustrated embodiment, the frangible structure comprises four distinct frangible bridges 26 regularly distributed around the periphery of the tamper-evident member 24. In a variant, the frangible structure 26 may be formed by a material of reduced thickness fully surrounding the tamper-evident member 24. The geometry of the outer cap 2 represented in FIG. 1 only serves as an example, and other geometries are also possible, as long as the tamper-evident member 24 is positioned at the first top wall 23 of the outer cap 2.

As shown in FIG. 3, the inner cap 4 comprises a second sidewall 41 and a second top wall 43. The top wall 43 is provided with a protruding element 46. It can be seen in FIG. 5 that the protruding element 46 has a geometry which corresponds to the geometry of the tamper-evident member 24 being part of the first top wall 23 of the outer cap 2. As will be explained below, the protruding element 46 is configured to remove the tamper-evident member 24 by breaking the frangible bridges 26 between the tamper-evident member 24 and the surrounding region 25, upon axial displacement of the outer cap 2 toward the inner cap 4 in the direction of the main axis $X_1$. In this case, the rupture of the frangible bridges 26 results from an axial stretching stress applied thereto in the direction of the main axis $X_1$.

As visible in FIGS. 4 and 5, the inner cap 4 is provided with an inner cap thread 44 which is configured to cooperate with the container thread 14 of the container 10. In this way, the closure 1 can be screwed onto the neck of the container 10 by rotation in a screwing direction $R_1$ which, in this example, is a clockwise direction. The inner cap 4 also comprises a sealing skirt 48, which is one form of the disclosed sealing member, which is configured to establish a sealing contact with the inner wall surface of the container 10 surrounding the dispensing opening 12. As shown in FIG. 5, the sealing skirt 48 has an inwardly slanted external sealing surface 49. Such a geometry of the sealing surface 49 promotes the tightness of the closure 1 when it is used on standardized bottles or containers, because the slanted sealing surface 49 can be more easily adapted to different dimensional variations of the inner side of the neck of a bottle or a container on which the closure 1 is used. With the slanted sealing surface 49, the sealing contact tends to be a line contact only, so that tolerances and even small irregularities of the dimensional variations of the neck of the container can be compensated for. As can be seen in FIG. 5, in the mounted state, there is a line contact between the slanted sealing surface 49 and the inner edge of the neck of the container 10, which provides for an optimum sealing contact due to the deformation of the sealing surface along the contact line. Further, the slanted sealing surface 49 makes it possible to adapt easily to dimensional variations in the thickness of the mouth of the container 10.

The inner cap 4 further comprises an annular wall 45, which defines a cavity 40 for receiving an active material 16 capable of regulating the atmosphere in the container 10, in particular a desiccant and/or an oxygen scavenger. As shown in FIG. 5, the cavity 40 is closed by a gas-permeable cover 15, which retains the active material 16 inside the cavity. In the represented example, the gas-permeable cover 15 is a cardboard held at its periphery by thinner extensions 45' of the annular wall 45 which have been crimped. As visible in FIG. 4, axial ribs 40' are provided in the inner surface of the annular wall 45 in order to improve the support of the cardboard 15 once the cavity 40 has been filled with an active material 16. In one embodiment, the gas-permeable cover 15 may be a porous membrane secured to the distal end of the annular wall 45, e.g. by heat-sealing, ultrasonic welding, overmolding, etc. In a variant, the inner cap 4 may be provided with a suitable attachment structure for holding a prefabricated canister containing an active material.

The first sidewall 21 of the outer cap 2 comprises a radially inwardly extending bead 22 which, in the mounted state of the outer cap 2 on the inner cap 4, forms a positive lock with a radially outwardly extending flange 42 provided on the second sidewall 41 of the inner cap 4. The inner bead 22 and the outer flange 42 cooperate in a such a way as to firmly hold the outer cap 2 on the inner cap 4, so that it can no longer be removed from the inner cap 4. As can be seen in the bottom view of FIG. 2, the outer cap 2 also comprises several coupling elements formed integrally on that side of the first top wall 23 which, in the mounted state, faces the second top wall 43 of the inner cap 4. The coupling elements of the outer cap 2 include, regularly distributed on the surrounding region 25, a plurality of elastic members 52, in the shape of inclined strips, and a plurality of peripheral driving ribs 72. Advantageously, each elastic member 52 has a geometry as described in WO2017/220729A1, with a basis extending substantially perpendicularly from the first top wall 23, followed by a transitional portion in which the elastic member 52 changes its direction into an angular position. A reinforcing rib, not represented in the figures, may also be provided next to the basis in a width direction of the elastic member 52, to increase the robustness and stiffness of the elastic member.

The inner cap 4 comprises corresponding coupling elements on the upper side of the top wall 43, around the protruding element 46, including a plurality of wedge-shaped elements 54 with beveled inclined surface and a plurality of peripheral serrations 74. Each wedge-shaped element 54 is configured to cooperate with an elastic member 52 of the outer cap, thus forming a first engagement mechanism, whereas each peripheral serration 74 is configured to cooperate with a peripheral driving rib 72 of the outer cap, thus forming a second engagement mechanism. The elastic members 52 are configured to bias the outer and inner caps away from each other in the direction of the main axis $X_1$, in such a way that the driving ribs 72 of the outer cap 2 are initially not engaged with the serrations 74 of the inner cap 4. When the outer cap 2 is axially displaced toward the inner cap 4 against the action of the elastic members 52, each driving rib 72 is received in the interspace between two successive serrations 74, more precisely between an edge **74*a* of a first serration 74 in the direction of screwing $R_1$ and an edge 74*b* of a second serration 74 in the direction of unscrewing $R_2$. By way of a non-limiting example, in this embodiment, the first engagement mechanism comprises five elastic members 52 on the outer cap 2 configured to cooperate with five wedge-shaped elements 54 of the inner cap 4, and the second engagement mechanism comprises ten driving ribs 72 on the outer cap 2 configured to cooperate with ten serrations 74 of the inner cap 4**.

The closure 1 further comprises a third engagement mechanism between the outer cap 2 and the inner cap 4, designed to break the frangible structure 26 upon relative rotational movement of the outer cap 2 and inner cap 4. The coupling elements of the third engagement mechanism include a plurality of studs 82, regularly arranged on the periphery of the tamper-evident member 24 and configured to cooperate with a plurality of corresponding recesses 84 provided on the protruding element 46. More precisely, each stud 82 is received in a corresponding recess 84 with possibility of axial displacement in the direction of the main axis $X_1$. As can be seen in particular in FIG. 6, for each pair of stud 82 and recess 84, the stud 82 has a first engaging edge 82*a* intended to cooperate with a first engaging edge 84*a* of the recess 84 upon relative rotational movement of the outer and inner caps when the outer cap 2 is rotated in the direction of screwing $R_1$, and a second engaging edge 82*b* intended to cooperate with a second engaging edge 84*b* of the recess 84 upon relative rotational movement of the outer and inner caps when the outer cap 2 is rotated in the direction of unscrewing $R_2$.

Advantageously, for each recess 84, the engaging edges 84*a* and 84*b* on each side of the recess have inclined surfaces, so that a stud 82 received in the recess 84 can climb smoothly on each inclined edge 84*a* or 84*b* upon relative rotational movement of the outer and inner caps when the outer cap is rotated in any of the rotation directions $R_1$ or $R_2$. The engaging edges 82*a* and 82*b* of each stud 82 may also have inclined surfaces, complementary to the inclined edges 84*a* or 84*b* of the inner cap, which further promotes the climbing of the stud 82 on the corresponding inclined edge 84*a* or 84*b*. When all the studs 82 present on the tamper-evident member 24 move upwardly on the inclined edges 84*a* or 84*b* of the inner cap, the tamper-evident member 24 is axially displaced away from the surrounding region 25, in the direction of the main axis $X_1$. This generates an axial stretching force in the frangible bridges 26 connecting the tamper-evident member 24 to the surrounding region 25, which ultimately results in the rupture of the frangible bridges 26.

Interestingly, in this embodiment, the mode of rupture of the frangible bridges 26 is the same, i.e. through axial stretching of the bridges, whether they are broken due to the abutting contact of the protruding element 46 or due to the cooperation of the coupling elements 82 and 84 of the third engagement mechanism. Advantageously, each stud 82 is positioned adjacent to a respective frangible bridge 26, which improves the breaking efficiency of the third engagement mechanism. As visible in FIG. 7, each frangible bridge 26 has a substantially U-shaped cross section, with a flat bottom wall 261 facing the inner cap 4 and a thinner middle portion 262, so that a rupture of the frangible bridge 26 preferably takes place at the thinner middle portion 262. With such a geometry of the frangible bridges, once the tamper-evident member 24 has been removed, a part of each frangible bridge 26 still protrudes out of the surrounding region 25, so that it becomes clearly visible that a part of the outer cap 2 has been broken away from the surrounding region and the container is no more tamper-proof. In addition, another part of each frangible bridge 26 remains attached to the tamper-evident member 24, with an irregular breaking area, so that the tamper-evident member 24 cannot be fraudulently repositioned in the surrounding region, in an attempt to hide that the closure 1 has been opened.

In order to increase the visibility, it is preferable that the protruding part of each frangible bridge 26 remaining attached to the surrounding region protrudes at least mm out of the surrounding region 25 and into the opening left once the tamper-evident member 24 has been removed. By way of a non-limiting example, in this embodiment, the third engagement mechanism comprises four studs 82 on the tamper-evident member 24 of the outer cap 2 configured to cooperate with four recesses 84 of the inner cap 4, each stud 82 being located next to a respective one of the four frangible bridges 26.

In operation, the outer cap 2 and the inner cap 4 nested therein can be rotated together to mount the closure 1 on the container 10. The clockwise rotation direction $R_1$ for screwing the cap thread 44 onto the container thread 14 brings each elastic member 52 in engagement with a higher edge 54*a* of a corresponding wedge-shaped element 54, even without any axial force being applied in the direction of the main axis $X_1$. The higher edge 54*a* provides an abutment for the corresponding elastic member 52, so that the inner cap is rotated in unison with the outer cap in the direction of screwing $R_1$. This locking interaction between the elastic members 52 and the wedge-shaped elements 54 without any axial force is possible only when closing the closure 1 on the container 20 by rotation in the direction of screwing $R_1$.

When a user rotates the outer cap 2 in a counterclockwise direction $R_2$ for unscrewing the cap thread 44 relative to the container thread 14, in an attempt to open the closure 1 without applying an axial force on the outer cap 2 in the direction of the main axis $X_1$, the elastic members 52 slip over the beveled inclined surfaces of the wedge-shaped elements 54. As a result, the rotation of the outer cap 2 does not lead to a corresponding rotation of the inner cap 4, which may generate a sufficient relative rotational movement of the outer cap 2 and the inner cap 4 such that the coupling elements 82 and 84 of the third engagement mechanism come in mutual engagement, thus breaking the frangible bridges 26. Of course, the same construction and functionalities can be provided in case that the rotational directions $R_1$ and $R_2$ for closing and opening the container 10 should be reversed. By way of a non-limiting example, in the illustrated embodiment, the height $h_1$ of the higher edge 54*a* of each wedge-shaped element 54 is of the order of 1 mm, whereas the height of the lower edge 54*b* of each wedge-shaped element 54 is substantially zero.

An opening of the closure 1 requires that the driving ribs 72 of the outer cap 2 are brought in engagement with the edges 74*b* of the serrations 74 of the inner cap 4. This is only possible after the outer cap 2 has been axially displaced toward the inner cap 4, against the action of the elastic members 52 biasing the outer and inner caps away from each other in the direction of the main axis $X_1$. When an axial pushing force F is applied onto the top surface of the top wall 23 in the direction of the main axis $X_1$, each driving rib 72 is received in the interspace between two successive serrations 74 and, upon rotation of the outer cap 2 in the counterclockwise direction of unscrewing $R_2$, can interact with the neighboring serration edge 74*b*, so that the inner cap 4 is also rotated in the same direction of unscrewing $R_2$. Then, when the axial pushing force F on the outer cap 2 is released, the elastic members 52 exert a biasing force toward disengagement of the driving ribs 72 and serrations 74, so that the elastic members 52 can return to their relaxed position and displace the outer cap 2 away from the inner cap 4 in the direction of the main axis $X_1$.

An initial setting of the closure 1 is that, in the initial mounting configuration of the closure, which is suitable for the initial mounting of the closure on a container and in practice corresponds to the configuration in which the inner cap 4 is initially nested in the outer cap 2, the angular stroke $\alpha_1$, in the direction of screwing $R_1$, for engagement of each elastic member 52 of the first engagement mechanism with the edge 54*a* of the corresponding wedge-shaped element 54, is less than or equal to, preferably less than, the angular stroke $\alpha_2$, in the direction of screwing $R_1$, for engagement of each stud 82 of the third engagement mechanism with the first engaging edge 84*a* of the corresponding recess 84.

Figure 6:
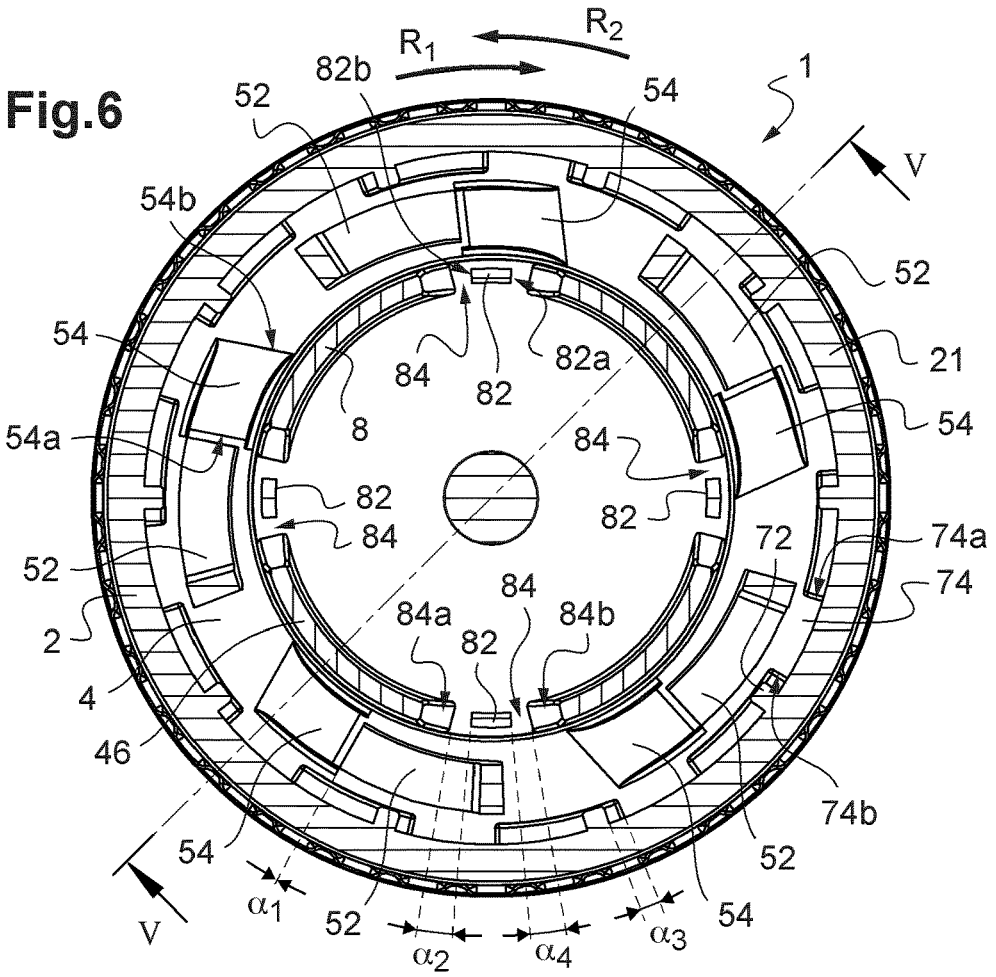
FIG. 6 is a cross section along line VI-VI of FIG. 5, where the line V-V corresponds to the cross section of FIG. 5.
Figure 10:
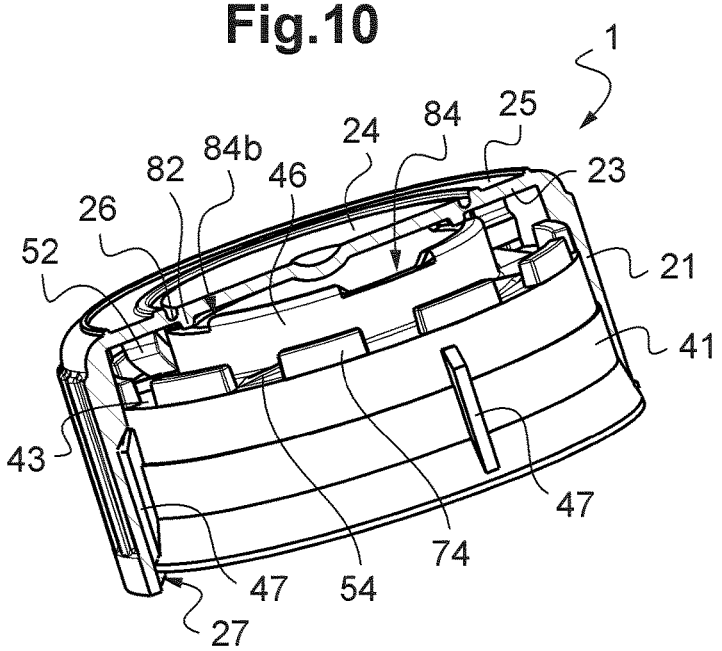
FIG. 10 is a perspective view with partial cutaway of the tamper-evident closure according to the second embodiment.
Figure 11:
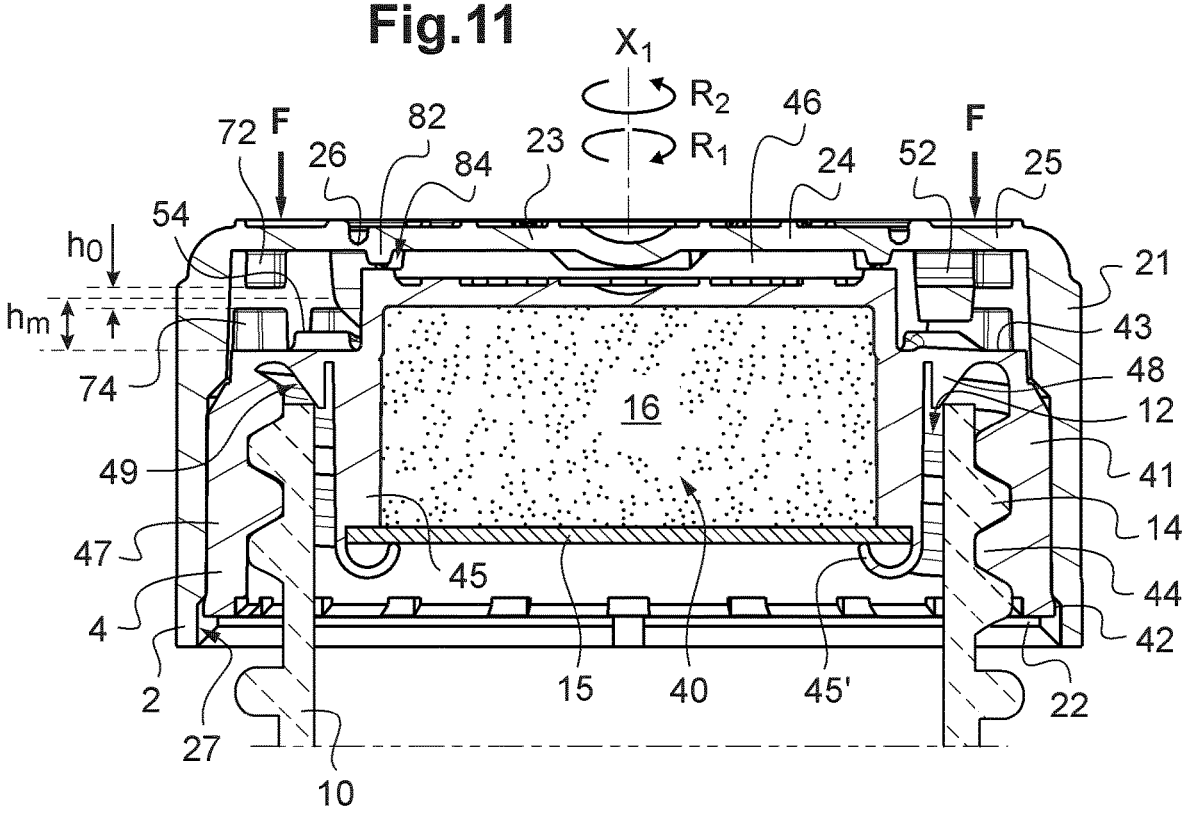
FIG. 11 is a cross section similar to FIG. 5 of the tamper-evident closure according to the second embodiment.
Figure 14:
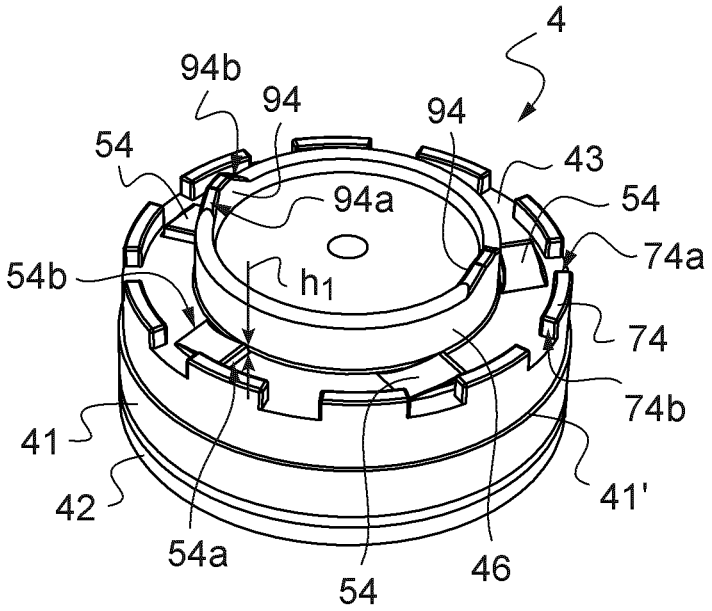
FIG. 14 is a perspective top view of the inner cap of the tamper-evident closure of FIG. 12.
Figure 15:
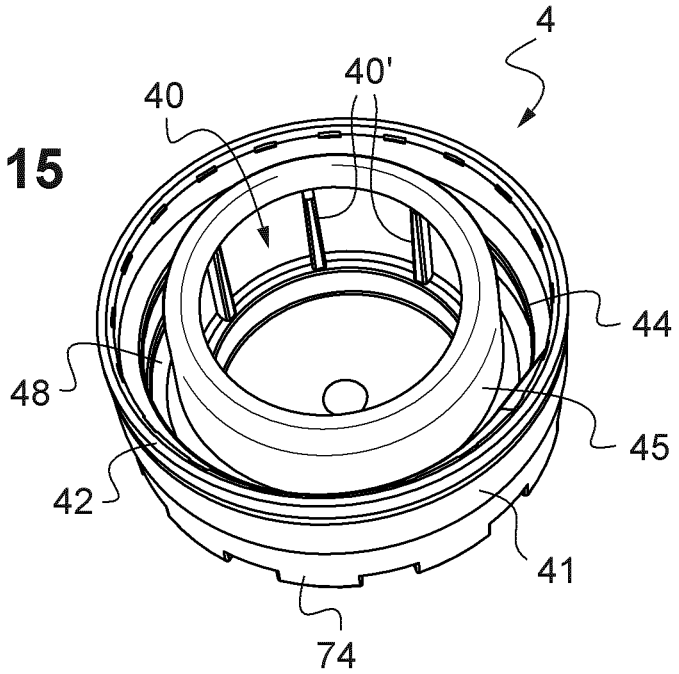
FIG. 15 is a perspective bottom view of the inner cap of the tamper-evident closure of FIG. 12.
Figure 16:
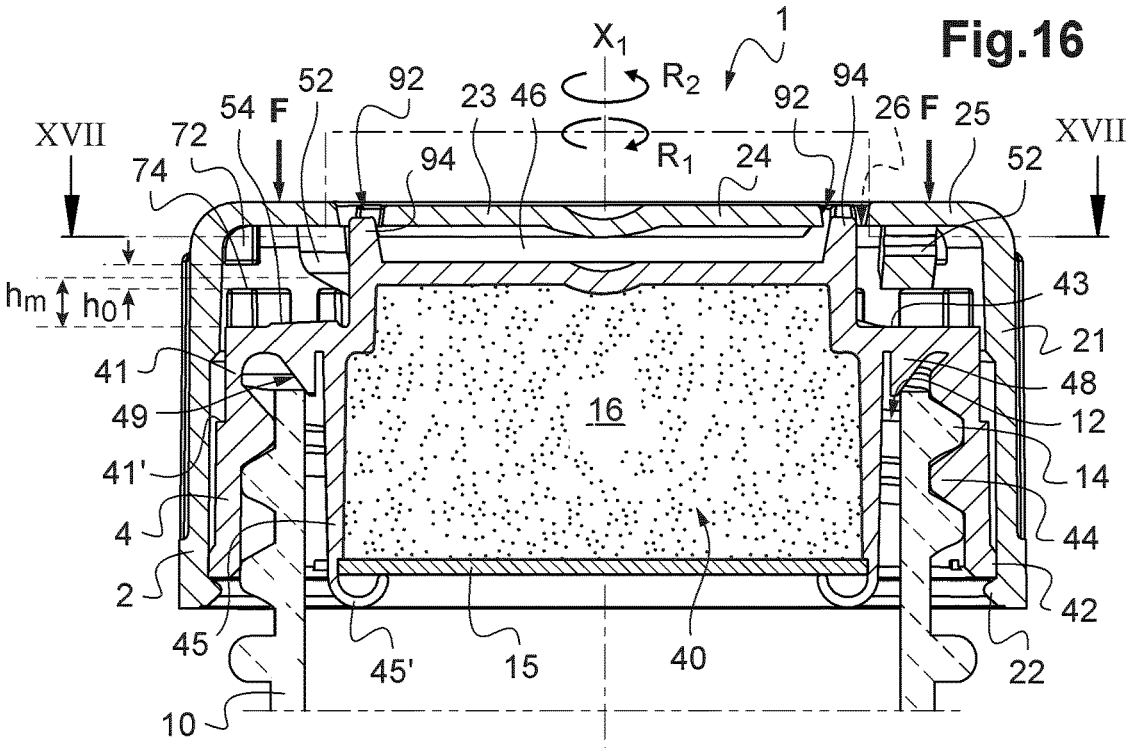
FIG. 16 is a cross section at larger scale according to plane XVI of FIG. 12.

This initial setting of the angular strokes $\alpha_1$ and $\alpha_2$ ensures that the closure 1 can be mounted on the container 10 without the frangible bridges 26 being broken by interaction between the coupling elements 82, 84 of the third engagement mechanism. In the initial mounting configuration of the closure, the coupling elements 52, 54 of the first engagement mechanism may be positioned in abutment against each other in pairs in the direction of screwing $R_1$, which corresponds to an angular stroke $\alpha_1$ substantially equal to zero, as shown in the example of FIG. 6. As a variant, in the initial mounting configuration of the closure 1, there may be an initial gap between the coupling elements 52, 54 of the first engagement mechanism.

FIG. 6 also illustrates that, in the initial mounting configuration of the closure, which is suitable for the initial mounting of the closure on a container, the angular stroke $\alpha_4$, in the direction of unscrewing $R_2$, for engagement of each stud 82 of the third engagement mechanism with the second engaging edge 84*b* of the corresponding recess 84, is substantially equal to the angular stroke $\alpha_2$, in the direction of screwing $R_1$, for engagement of each stud 82 of the third engagement mechanism with the first engaging edge 84*a* of the corresponding recess 84. In this way, starting from the initial mounting configuration of the closure, the efficiency of the third engagement mechanism in breaking the frangible structure 26, upon relative rotational movement of the outer cap 2 and the inner cap 4, is substantially the same in any of the rotational directions $R_1$ or $R_2$. However, in other embodiments, the angular strokes $\alpha_2$ and $\alpha_4$ may also have different values.

It can be noted that the angular stroke $\alpha_3$, in the direction of unscrewing $R_2$, for engagement of each driving rib 72 of the second engagement mechanism with the corresponding serration edge 74*b*, may be selected independently from the other angular strokes $\alpha_1$, $\alpha_2$, $\alpha_4$, since the second engagement mechanism is active only in a configuration where the outer cap 2 is pressed toward the inner cap 4 and the tamper-evident member 24 has necessarily been detached from the surrounding region 25.

Another initial setting of the closure 1 is its axial clearance $h_0$, which corresponds to the axial displacement of the outer cap 2 toward the inner cap 4, in the direction of the main axis $X_1$, between the initial mounting configuration of the closure and the configuration of the closure where the coupling elements 72, 74 of the second engagement mechanism start to be in mutual engagement. The axial clearance $h_0$ is selected to be higher than or equal to, preferably higher than, the axial displacement needed for the protruding element 46 to come into abutting contact with the tamper-evident member 24 and break the frangible bridges 26 so that, when the coupling elements 72, 74 of the second engagement mechanism are in mutual engagement, the tamper-evident member 24 has been detached from the surrounding region 25 under the pressure exerted by the protruding element 46.

Additionally, the axial clearance $h_0$ is selected to be less than or equal to the maximum stroke $h_m$ of the outer cap 2 toward the inner cap 4, in the direction of the main axis $X_1$, so as to ensure that the coupling elements 72, 74 of the second engagement mechanism can effectively come into mutual engagement. As shown in FIG. 5, the maximum stroke $h_m$ is equal to the distance obtained when the height of the basis of each elastic member 52, i.e. the height of the part of each elastic member 52 extending substantially perpendicularly from the surrounding region 25, is subtracted from the initial distance between the surrounding region 25 and the second top wall 43 in the initial mounting configuration of the closure. By way of a non-limiting example, in this embodiment, the axial clearance $h_0$ is of the order of 1.3 mm, whereas the maximum stroke $h_m$ is of the order of 2.3 mm. The maximum stroke $h_m$ is also higher than or equal to, preferably higher than, the axial displacement needed for the protruding element 46 to come into abutting contact with the tamper-evident member 24 and break the frangible bridges 26.

In the second embodiment shown in FIGS. 8 to 11, elements that are similar to those of the first embodiment have the same references. The tamper-evident closure 1 of the second embodiment differs from the first embodiment in that it comprises an indexing mechanism for positioning the outer cap 2 and the inner cap 4 in the initial mounting configuration of the closure 1, with predefined angular strokes $\alpha_1$, $\alpha_2$, $\alpha_3$, $\alpha_4$ for engagement of the coupling elements of the first, second and third engagement mechanisms. As visible in FIGS. 8 to 11, in this second embodiment, the indexing mechanism comprises four axial indexing ribs 47 provided on the external surface of the sidewall 41 of the inner cap 4, which are configured to cooperate with four complementary indexing grooves 27 provided on the internal surface of the sidewall 21 of the outer cap 2.

The indexing ribs 47 are equidistantly distributed around the periphery of the inner cap, and it is the same for the indexing grooves 27 around the outer cap, so that the relative position of the two caps is accurately controlled over their entire circumference during assembly. The complementary indexing ribs 47 and grooves 27 are designed to guide the outer cap 2 and the inner cap 4 toward the initial mounting configuration of the closure 1, but also to leave the outer cap 2 and the inner cap 4 freely rotatable relative to each other once in the initial mounting configuration of the closure. More precisely, as can be seen in particular in the partial cutaway of FIG. 10, the indexing grooves 27 are provided only in the inner bead 22 of the outer cap so that, once the outer flange 42 of the inner cap has been locked behind the inner bead 22 of the outer cap, the indexing ribs 47 are not retained anymore in the circumferential direction and the inner cap 4 can rotate freely inside the outer cap 2.

Of course, within the frame of the invention, the relative positioning of the outer cap 2 and the inner cap 4 corresponding to the initial mounting configuration of the closure 1 with predefined values of the strokes $\alpha_1$, $\alpha_2$, $\alpha_3$, $\alpha_4$ can be obtained with indexing means other than an indexing mechanism involving a mechanical guiding by complementary structures in relief. For example, in embodiments where the outer cap 2 and the inner cap 4 are devoid of such indexing complementary structures in relief, the initial mounting configuration of the closure 1 may be reached using a visual inspection system, e.g. comprising a camera for angularly pre-positioning the inner cap 2 relative to the outer cap 4 around the main axis $X_1$ of the closure before the inner cap 4 is nested in the outer cap 2.

In the third embodiment shown in FIGS. 12 to 17, elements that are similar to those of the first embodiment have the same references. The tamper-evident closure 1 of the third embodiment differs from the first embodiment in the structure of the third engagement mechanism, which includes female coupling elements 92 on the outer cap 2 and male coupling elements 94 on the inner cap 4. This is reversed from the first embodiment, where the third engagement mechanism includes male coupling elements 82 on the outer cap 2 and female coupling elements 84 on the inner cap 4. More precisely, in the third embodiment, the coupling elements of the third engagement mechanism include two slots 92 arranged diametrically opposed on the periphery of the tamper-evident member 24 and configured to cooperate with two teeth 94 provided on the protruding element 46. Each tooth 94 is received in the corresponding slot 92 with possibility of axial displacement in the direction of the main axis $X_1$. In this embodiment, each slot 92 is sized to receive and interact with a corresponding tooth 94, while not allowing the insertion therein of a tool to unscrew the inner cap without breaking the frangible bridges 26.

Figure 17:
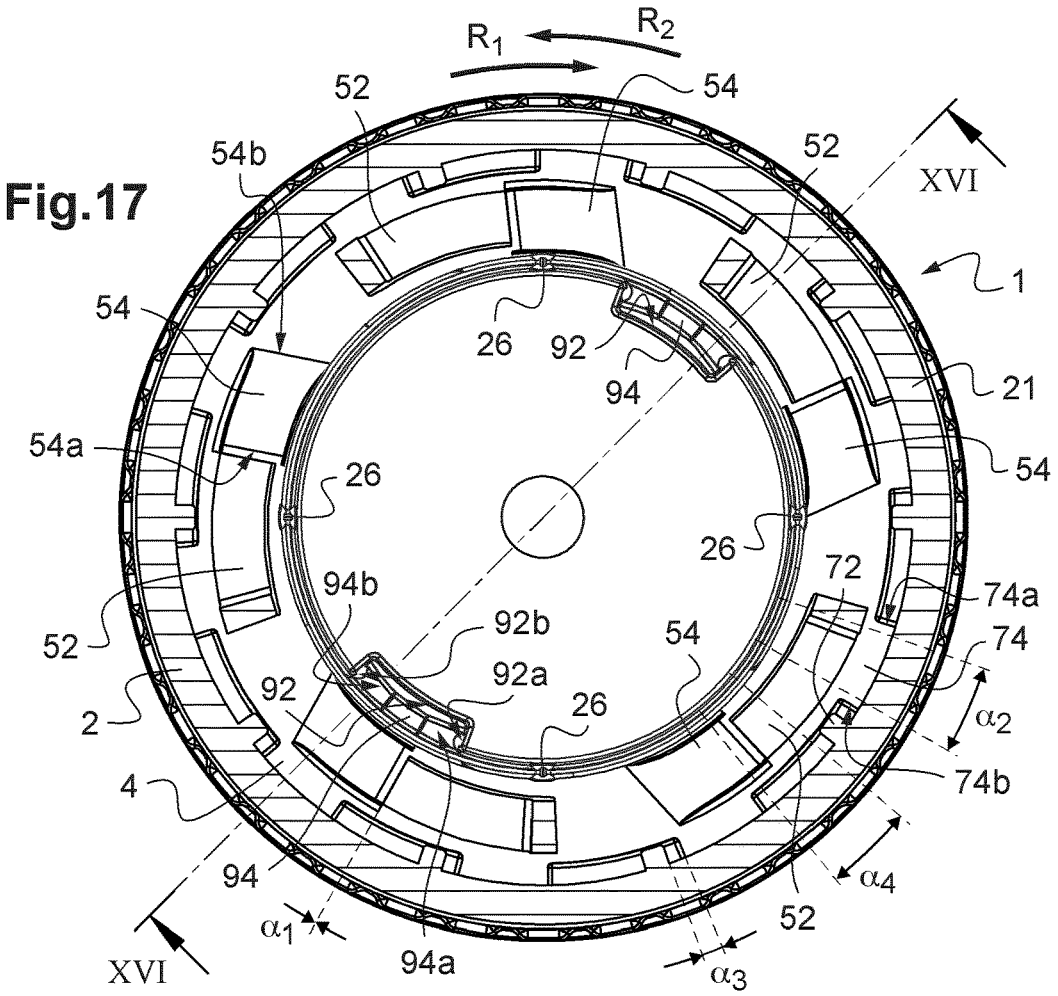
FIG. 17 is a cross section along line XVII-XVII of FIG. 16, where the line XVI-XVI corresponds to the cross section of FIG. 16.
Figure 18:
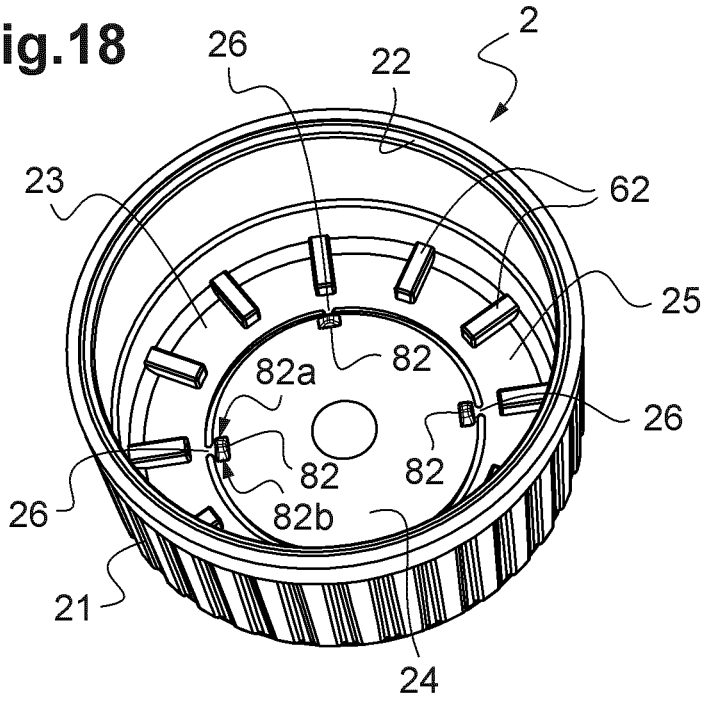
FIG. 18 is a perspective bottom view similar to FIG. 2 of the outer cap of a tamper-evident closure according to a fourth embodiment of the invention.
Figure 19:
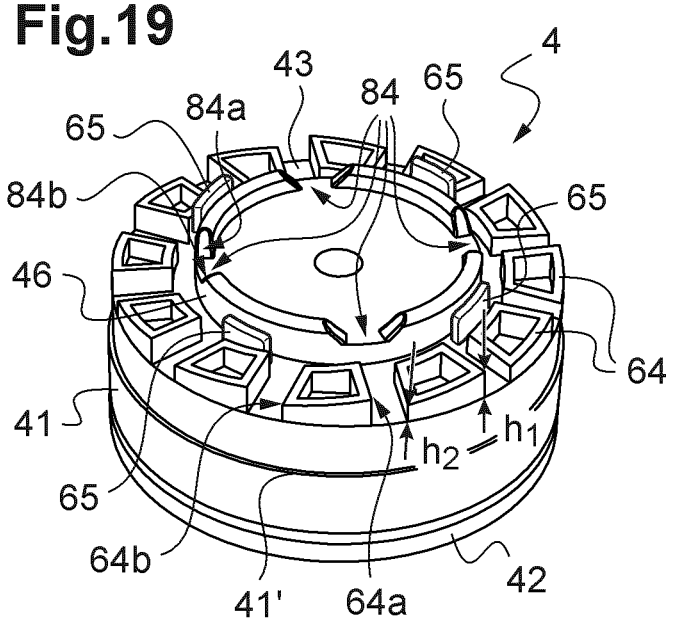
FIG. 19 is a perspective top view similar to FIG. 3 of the inner cap of the tamper-evident closure according to the fourth embodiment.

As can be seen in particular in FIG. 17, for each pair of slot 92 and tooth 94, the tooth 94 has a first engaging edge 94*a* intended to cooperate with a first engaging edge 92*a* of the slot 92 upon relative rotational movement of the outer and inner caps when the outer cap 2 is rotated in the direction of screwing $R_1$, and a second engaging edge 94*b* intended to cooperate with a second engaging edge 92*b* of the slot 92 upon relative rotational movement of the outer and inner caps when the outer cap 2 is rotated in the direction of unscrewing $R_2$. As best visible in FIGS. 14 and 17, for each tooth 94, the engaging edges 94*a* and 94*b* delimiting the tooth have inclined surfaces. In this way, the engaging edge 92*a* or 92*b* of the slot 92 surrounding the tooth 94 can climb on the corresponding inclined edge 94*a* or 94*b* of the tooth upon relative rotational movement of the outer and inner caps when the outer cap is rotated in any of the rotation directions $R_1$ or $R_2$.

When the engaging edges 92*a* or 92*b* of the two slots 92 provided in the tamper-evident member 24 move upwardly on the inclined edges 94*a* or 94*b* of the two teeth 94 of the inner cap, the tamper-evident member 24 is axially displaced away from the surrounding region 25, in the direction of the main axis $X_1$. This generates an axial stretching force in the frangible bridges 26 connecting the tamper-evident member 24 to the surrounding region 25, which ultimately results in the rupture of the frangible bridges 26. As in the first embodiment, the rupture of the frangible bridges 26 results from axial stretching of the bridges whether they are broken due to the abutting contact of the protruding element 46 or due to the cooperation of the coupling elements 92 and 94 of the third engagement mechanism.

In the fourth embodiment shown in FIGS. 18 to 23, elements that are similar to those of the first embodiment have the same references. The tamper-evident closure 1 of the fourth embodiment differs from the first embodiment in that the first and second engagement mechanisms use the same coupling elements 62, 64, which are designed to come in mutual engagement in pairs according to two different configurations, depending on whether the outer cap 2 is rotated in the direction of screwing $R_1$ or in the direction of unscrewing $R_2$. In addition, in the fourth embodiment, there is no elastic member for biasing the outer cap 2 and the inner cap 4 away from each other in the direction of the main axis $X_1$. In the fourth embodiment, the elastic action against which the coupling elements 62, 64*b* of the second engagement mechanism are brought in mutual engagement, and by which they are automatically disengaged when the axial force is released, is provided directly by the outer cap which is designed to be elastically deformable.

In the fourth embodiment, the outer cap 2 includes, regularly distributed on the surrounding region 25, a plurality of radial ribs 62 configured to cooperate with corresponding wedge-shaped elements 64 with beveled inclined surface provided on the top wall 43 of the inner cap 4, around the protruding element 46. The inner cap 4 also comprises, projecting from its top wall 43, a plurality of support elements 65 with an arcuate shape, which are located between the wedge-shaped elements 64 and the protruding element 46. In the non-limiting example represented in FIGS. 18 to 23, there are four support elements 65 regularly distributed on the top wall 43 of the inner cap 4 around the protruding element 46, and twelve radial ribs 62 on the outer cap 2 configured to cooperate with twelve wedge-shaped elements 64 of the inner cap 4. The coupling elements of the first engagement mechanism are the radial ribs 62 and the higher edges 64*a* of the wedge-shaped elements 64, whereas the coupling elements of the second engagement mechanism are the radial ribs 62 and the lower edges 64*b* of the wedge-shaped elements 64. The closure 1 of the fourth embodiment further comprises a third engagement mechanism which is identical to that of the first embodiment, i.e. comprising a plurality of studs 82 of the outer cap 2 configured to cooperate with a plurality of recesses 84 provided on the protruding element 46 of the inner cap 4.

Figure 20:
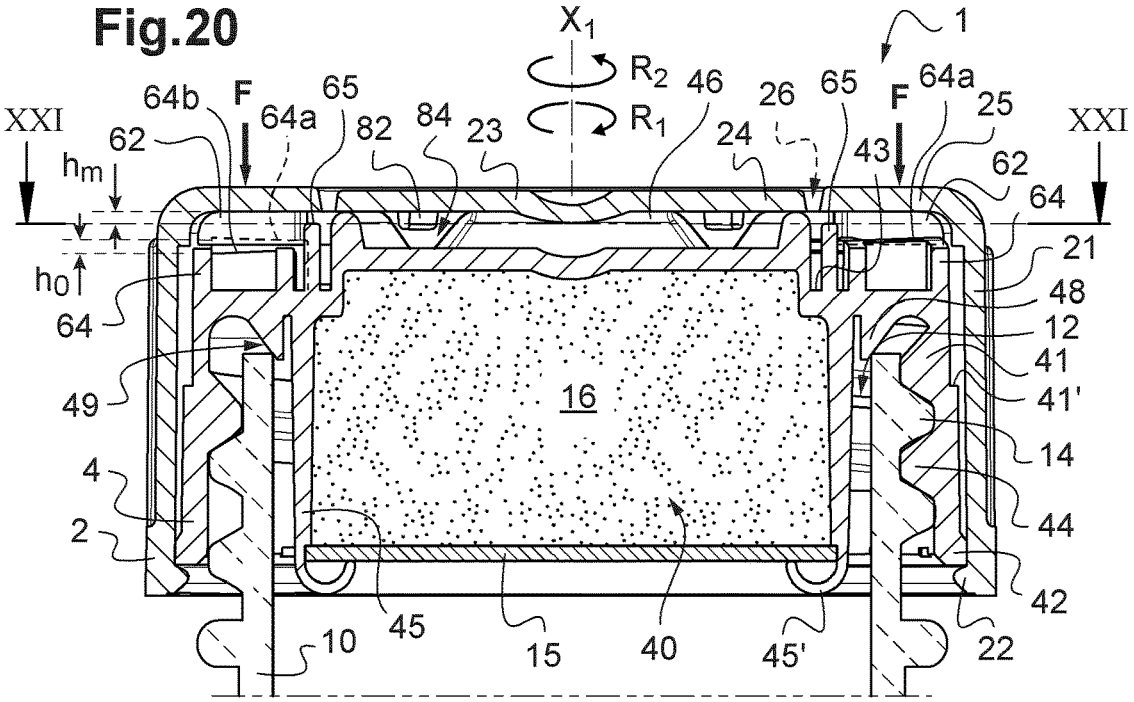
FIG. 20 is a cross section similar to FIG. 5 of the tamper-evident closure according to the fourth embodiment.

As shown in FIG. 20, in this fourth embodiment, the initial mounting configuration of the closure 1, suitable for the initial mounting of the closure on a container 10, is such that the radial ribs 62 are in contact with the higher edges 64*a*, with possibility of axial movement of the radial ribs 62 in the interspace between the wedge-shaped elements 64 in the direction of the main axis $X_1$, whereas the tamper-evident member 24 rests on the protruding element 46. In this fourth embodiment, the tamper-evident member 24 is configured to be detached from the surrounding region 25 upon application on the outer cap 2 of an axial pushing force F in the direction of the main axis $X_1$, so that the protruding element 46 is displaced in pushing abutment against the tamper-evident member 24, thus breaking the frangible bridges 26, while at the same time the radial ribs 62 are displaced in the interspace between the wedge-shaped elements 64 toward the lower edges 64*b* of the wedge-shaped elements 64.

Figure 21:
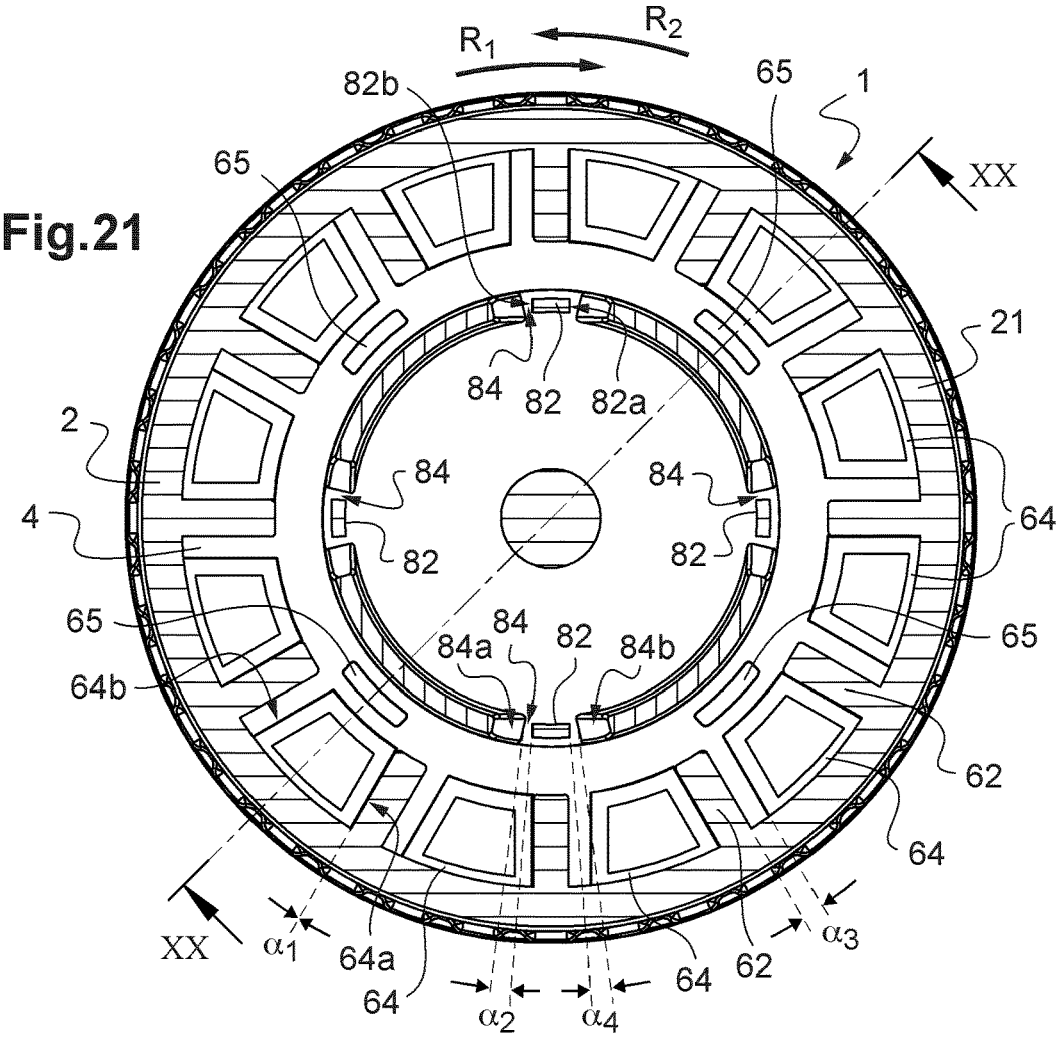
FIG. 21 is a cross section similar to FIG. 6 of the tamper-evident closure according to the fourth embodiment, where the line XX-XX corresponds to the cross section of FIG. 20.

As in the first embodiment, an initial setting of the closure 1 is that, in the initial mounting configuration of the closure, the angular stroke $\alpha_1$, in the direction of screwing $R_1$, for engagement of each radial rib 62 with the higher edge 64*a* of the corresponding wedge-shaped element 64, is less than or equal to, preferably less than, the angular stroke $\alpha_2$, in the direction of screwing $R_1$, for engagement of each stud 82 of the third engagement mechanism with the first engaging edge 84*a* of the corresponding recess 84. This initial setting of the angular strokes $\alpha_1$ and $\alpha_2$ ensures that the closure 1 can be mounted on the container 10 without the frangible bridges 26 being broken by interaction between the coupling elements 82, 84 of the third engagement mechanism. By way of example, in the initial mounting configuration of the closure, the coupling elements 62, 64*a* of the first engagement mechanism may be positioned in abutment against each other in pairs in the direction of screwing $R_1$, which corresponds to an angular stroke $\alpha_1$ substantially equal to zero, as shown in FIG. 21.

Here again, in the initial mounting configuration of the closure, which is suitable for the initial mounting of the closure on a container, the angular stroke $\alpha_4$, in the direction of unscrewing $R_2$, for engagement of each stud 82 of the third engagement mechanism with the second engaging edge 84*b* of the corresponding recess 84, is substantially equal to the angular stroke $\alpha_2$, in the direction of screwing $R_1$, for engagement of each stud 82 of the third engagement mechanism with the first engaging edge 84*a* of the corresponding recess 84. However, in other embodiments, the angular strokes $\alpha_2$ and $\alpha_4$ may have different values. In addition, the angular stroke $\alpha_3$, in the direction of unscrewing $R_2$, for engagement of each radial rib 62 with the corresponding lower edge 64*b* of the second engagement mechanism, may be selected independently from the other angular strokes $\alpha_1$, $\alpha_2$, $\alpha_4$, since the second engagement mechanism is active only in a configuration where the outer cap 2 is pressed toward the inner cap 4 and the tamper-evident member 24 has necessarily been detached from the surrounding region 25.

Another initial setting of the closure 1 of the fourth embodiment is its axial clearance $h_0$, which corresponds to the axial displacement of the outer cap 2 toward the inner cap 4, in the direction of the main axis $X_1$, between the initial mounting configuration of the closure and the configuration of the closure where the coupling elements 62, 64*b* of the second engagement mechanism start to be in mutual engagement. The axial clearance $h_0$ is selected to be higher than or equal to, preferably higher than, the axial displacement needed for the protruding element 46 to come into abutting contact with the tamper-evident member 24 and break the frangible bridges 26 so that, when the coupling elements 62, 64*b* of the second engagement mechanism are in mutual engagement, the tamper-evident member 24 has been detached from the surrounding region 25 under the pressure exerted by the protruding element 46.

In this fourth embodiment, the maximum stroke $h_m$ of the outer cap 2 toward the inner cap 4 in the direction of the main axis $X_1$, without deformation of the outer cap 2, is equal to the axial distance between the surrounding region 25 and the support elements 65. In this embodiment, contrarily to the preceding embodiments, the axial clearance $h_0$ is higher than the maximum stroke $h_m$, and an elastic deformation of the outer cap 2 is required to reach the mutual engagement of the coupling elements 62, 64*b*. By way of a non-limiting example, in this fourth embodiment, the height $h_1$ of the higher edge 64*a* is of the order of 2.8 mm; the height $h_2$ of the lower edge 64*b* of each wedge-shaped element 64 is of the order of 1.5 mm; the axial clearance $h_0$ is of the order of 1.3 mm; the maximum stroke $h_m$ is of the order of 0.8 mm. Preferably, the maximum stroke $h_m$ is selected to be higher than or equal to, preferably higher than, the axial displacement needed for the protruding element 46 to come into abutting contact with the tamper-evident member 24 and break the frangible bridges 26.

In operation, when a rotational torque in the direction of screwing $R_1$ is applied on the outer cap 2, even without any axial force in the direction of the main axis $X_1$, the radial ribs 62 are in a locking arrangement with the higher edges 64*a* of the wedge-shaped elements 64, so that the inner cap 4 is rotated in unison with the outer cap in the direction $R_1$, thus making it possible to mount the closure 1 on the container 10. Conversely, when a user rotates the outer cap 2 in the direction of unscrewing $R_2$, in an attempt to open the closure 1 without applying an axial force on the outer cap 2 in the direction of the main axis $X_1$, the radial ribs 62 slip over the beveled inclined surfaces of the wedge-shaped elements 64 and the rotation of the outer cap 2 does not lead to a corresponding rotation of the inner cap 4, which may generate a relative rotational movement of the outer cap 2 and the inner cap 4 sufficient for the coupling elements 82 and 84 of the third engagement mechanism to come in mutual engagement, thus breaking the frangible bridges 26.

Figure 22:
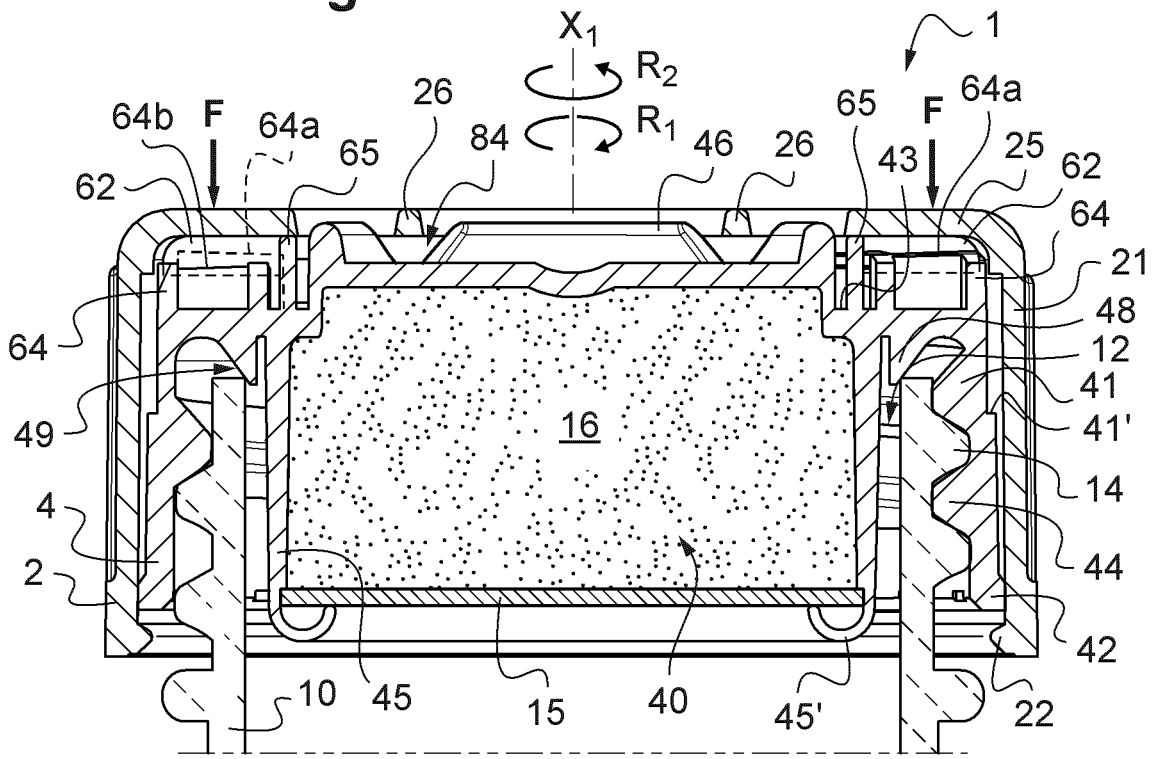
FIG. 22 is a cross section similar to FIG. 21, in a configuration of the tamper-evident closure corresponding to a first step of unscrewing the closure from a container.
Figure 23:
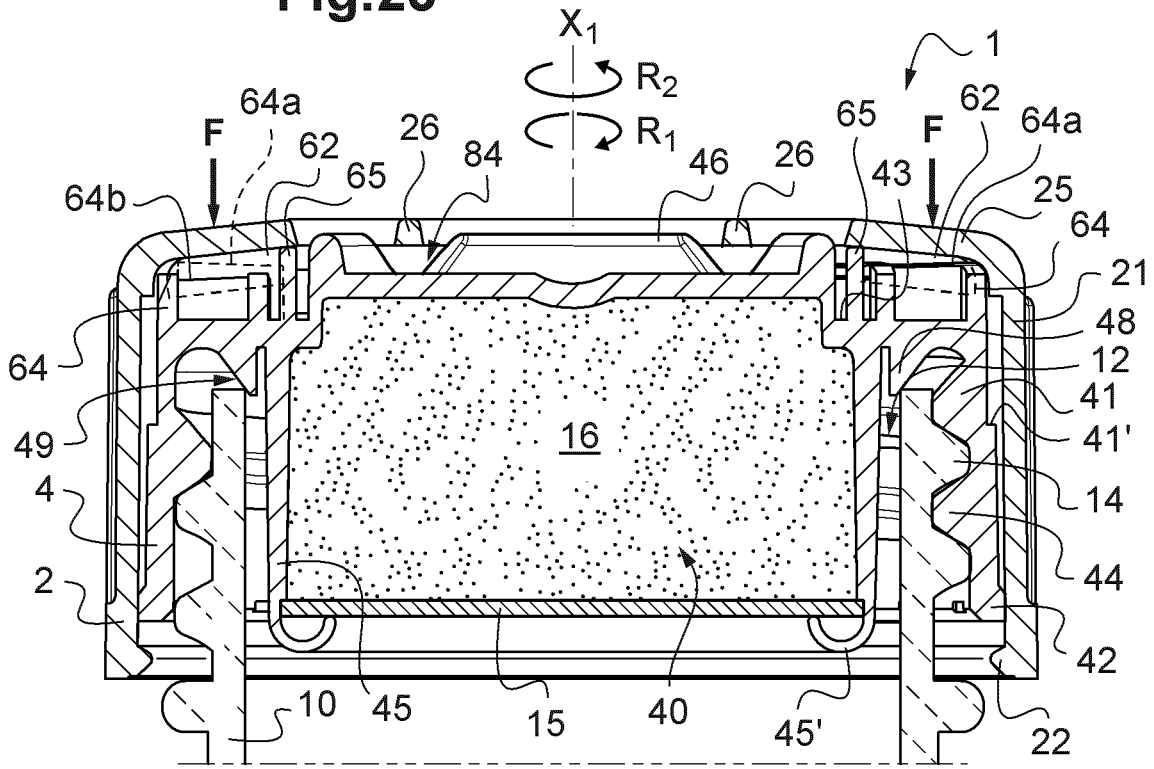
FIG. 23 is a cross section similar to FIG. 21, in a configuration of the tamper-evident closure corresponding to a second step of unscrewing the closure from a container.

An opening of the closure 1 requires that the radial ribs 62 of the outer cap 2 are brought in engagement with the lower edges 64*b* of the wedge-shaped elements 64 of the inner cap 4, which is only possible when the outer cap 2 is axially displaced and deformed toward the inner cap 4, in particular under the action of an axial pushing force F applied on the top wall 23 in the direction of the main axis $X_1$, as shown in FIG. 20. More precisely, as shown in FIGS. 22 and 23, the engagement of the radial ribs 62 with the lower edges 64*b* of the wedge-shaped elements 64 is obtained through two steps. In a first step, under the action of the axial force F applied on the surrounding region 25, the outer cap 2 is displaced axially toward the inner cap 4, according to the maximum stroke $h_m$, i.e. until the surrounding region 25 comes in abutment against the supporting elements 65. In this configuration, shown in FIG. 22, the tamper-evident member 24 has been detached from the surrounding region 25 under the pressure exerted by the protruding element 46.

In a second step, under the continued action of the axial force F applied on the surrounding region 25, which is supported by the supporting elements 65, the outer cap 2 is elastically deformed so that the radial ribs 62 are slightly rotated and further displaced in the direction of the main axis $X_1$ toward the top wall 43 of the inner cap 4. In this way, as shown in FIG. 23, under the continued application of the axial pushing force F, the radial ribs 62 can interact with the lower edges 64*b* so that rotation of the outer cap 2 in the direction of unscrewing $R_2$ also rotates the inner cap 4 in the same direction. In the fourth embodiment, in the absence of elastic members for biasing the outer cap 2 and the inner cap 4 away from each other, the child-resistant properties of the closure 1 are maintained even after the first use thanks to the elasticity of the outer cap 2. In practice, when the axial pushing force F on the outer cap 2 is released, the outer cap elastically returns to its initial configuration, which disengages the radial ribs 62 from the edges 64*b* of the wedge-shaped elements 64.

As can be seen from the above description of several embodiments of a closure according to the invention, the mounting (or closing) of the closure 1 onto a container is easy to achieve and only requires a simple rotational movement of the outer cap 2 in the direction of screwing $R_1$, whereas the opening of the closure 1 requires a complex operation starting with an axial displacement of the outer cap 2 toward the inner cap 4 under an axial pressure force F in the direction of the main axis $X_1$, followed by a rotational movement in the direction of unscrewing $R_2$ while maintaining the axial pressure force F. Such complex operation establishes a highly effective child resistance of the closure 1. As illustrated in the above embodiments, the child resistance of a closure according to the invention may be obtained thanks to the presence of at least one elastic member configured to bias the outer cap 2 and the inner cap 4 away from each other, or else thanks to a reversible elastic deformation of the outer cap 2. When the closure comprises at least one elastic member provided between the outer cap 2 and the inner cap 4, for biasing the first and second top walls away from each other in the direction of the main axis $X_1$, the at least one elastic member may form coupling element(s) of at least one engagement mechanism of the closure 1, as illustrated in the first, second and third embodiments described above, or in a variant not shown in the figures, the at least one elastic member may be a dedicated spring member independent from the engagement mechanisms of the closure 1.

In addition, when using the closure 1 for the first time, the axial displacement of the outer cap 2 toward the inner cap 4 is used to break the frangible structure 26 between the tamper-evident member 24 and the surrounding region 25 of the outer cap 2. More precisely, when first pushing down the closure 1, the protruding element 46 comes in abutting contact with the tamper-evident member 24, so that the frangible bridges 26 are broken and the tamper-evident member 24 separates from the surrounding region 25. In case of an attempt to open the closure 1 fraudulently, without securing the outer cap 2 and the inner cap 4 together in rotation, the third engagement mechanism ensures that the frangible bridges 26 are also broken, upon relative rotational movement of the outer and inner caps when the outer cap is rotated in any of the rotation directions $R_1$ or $R_2$. According to an advantageous feature visible e.g. in the cross sections of FIGS. 5, 16 and the inner cap may comprise an outer peripheral shoulder 41', making it possible to limit the surface area over which the sidewalls 21 and 41 closely overlap one another. Such a configuration reduces the rotational torque that can be transferred from the outer cap 2 to the inner cap 4 through friction between the sidewalls 21 and 41, in case of an attempt to open the closure 1 fraudulently by radially deforming the outer cap 2.

Preferably, the tamper-evident member 24 has a diameter as large as possible, e.g. a diameter of the tamper-evident member is at least 60% of the diameter of the outer cap 2. Preferably, the radial width of the surrounding region 25 is higher than or equal to 5 mm. Advantageously, the tamper-evident member 24 is integrally formed with the remainder of the top wall 23 of the outer cap 2. The tamper-evident member 24 can be of a different color and/or of a different material from the surrounding region 25. This may be realized, e.g., by means of a bi-injection molding process. For example, it is possible to first mold the tamper-evident member, and then mold the surrounding region 25 and the first sidewall 21 of the outer cap 2 in the same mold. Alternatively, it is possible to first mold the outer cap 2 with a hollow space in the top wall 23, and then mold the tamper-evident member 24 in the same mold. By using a color for the tamper-evident member 24 that is different from the color for the remaining part of the outer cap 2, the tampering becomes more evident.

In all embodiments, the outer cap 2 and the inner cap 4 are advantageously manufactured by injection molding of suitable polymer material(s), which may be one and the same polymer material for all of the outer cap and the inner cap, or different polymer materials selected according to the intended function of each cap, or even according to the intended function of each portion of each cap. Examples of suitable polymers for both caps include polyolefin-based polymers, in particular polyethylene or polypropylene. In one embodiment, the constitutive polymer of the outer cap 2 is the same as the constitutive polymer of the inner cap 4, e.g. high-density polyethylene (HDPE). In another embodiment, the constitutive polymer of the outer cap 2 is different from the constitutive polymer of the inner cap 4, e.g. the outer cap may be made of polypropylene (PP) or polyoxymethylene (POM), whereas the inner cap may be made of high-density polyethylene (HDPE). Polypropylene (PP) and polyoxymethylene (POM) are polymer materials that are advantageous for the outer cap, especially as they are brittle materials, which is required for the rupture of the frangible structure, but also flexible materials, which is required for the elastic properties of the elastic members 52, as illustrated in the first, second and third embodiments, and/or the elastic properties of the outer cap itself, as illustrated in the fourth embodiment.

The selection of different constitutive materials for the outer cap 2 and the inner cap 4 is also advantageous to reduce the coefficient of friction at the interface between the two caps and improve the transmission of movement from one cap to the other. The constitutive material of the sealing member of the inner cap 4 may also be a specific polymer, especially with a Young's coefficient lower than that of the remainder of the inner cap 4. By way of a non-limiting example, when the remainder of the inner cap 4 is made of HDPE, the sealing member may be made of low-density polyethylene (LDPE) or of a thermoplastic elastomer.

Preferably, the outer cap 2 and the inner cap 4 are each configured to be demolded without requiring a mold with sliding parts. In embodiments where the outer cap 2 comprises elastic members 52 which start from the top wall 23 in a vertical direction and then run in an oblique direction, as shown in the first, second and third embodiments above, it is preferable to have a core of the mold in two parts for molding the internal surface of the outer cap. More precisely, a mold adapted for the molding of the outer cap 2 with elastic members 52 comprises a central core part for molding a central portion of the top wall 23 and the surface of the elastic members 52 facing the top wall 23, and an outer annular core part for molding the internal surface of the sidewall 21, the remainder of the top wall 23 and the surface of the elastic members 52 opposite from the top wall 23. In this way, once molded, the outer cap 2 can be separated first from the outer annular core part of the mold, allowing the elastic members 52 to then flex and be released gently from the central core part of the mold with a turning movement. In the case where the outer cap 2 additionally comprises male coupling elements 82 on the internal surface of the tamper-evident member 24, the draft angle of each male coupling element 82 is advantageously selected to correspond to the helix pitch for releasing the outer cap 2 from the central core part of the mold. In other words, with reference to the illustrative embodiments described above, the inclination angle of the first engaging edge 82*a* of each stud 82 corresponds to the helix pitch of the elastic members 52.

The constitutive materials of the closure and the container of the invention, as well as the active material received in the cavity of the closure for regulation of the atmosphere inside the container, are selected according to the intended use of the container. An advantage of the closure according to the invention is its high versatility, as it can be used for all screw-necked bottles or containers. Without any modification to a conventional screw necked bottle or container, it is possible to combine the three functions of being child-resistant, tamper-evident and providing active control of the atmosphere in the container. Because of its high safety, not only as being childproof, but also as being tamper-evident thanks to the third engagement mechanism, which makes any fraudulent opening of the closure visible by systematically breaking the tamper-evident member, a container with a closure according to the invention is advantageously used for storing tablets or capsules containing a pharmaceutical composition; nutraceuticals; herbalism products; or diagnostic products.

The invention is not limited to the examples described and shown.

In particular, the geometry and the distribution of the coupling elements of the various engagement mechanisms may be different from those described above. For example, when the frangible structure 26 includes a plurality of discrete frangible bridges, the coupling elements of the third engagement mechanism can indifferently be located near or far from the frangible bridges, e.g. depending on manufacturing constraints of the outer and inner caps, even if it is considered that the closer they are to the frangible bridges, the better the breaking efficiency of the third engagement mechanism.

According to a variant not shown in the figures, the third engagement mechanism may be designed such that the engaging edge of the second coupling element provided on the inner cap 4 is a substantially straight edge, instead of an inclined edge as described above, against which the first coupling element provided on the tamper-evident member 24 is configured to press circumferentially upon relative rotational movement of the outer and inner caps when the outer cap 2 is rotated in the direction of unscrewing. In this case, the tamper-evident member 24 tends to be displaced circumferentially relative to the surrounding region 25, resulting in shear stress being applied to the frangible structure 26. Then, in this variant, the frangible structure should be designed to break according to two different modes of rupture, i.e. firstly, it should rupture under an axial stretching stress applied to it, which may be obtained with a design of the frangible structure having a thinner middle portion in the direction of the main axis of the closure, as visible in FIG. 7; and secondly, it should also rupture under a circumferential shear stress applied to it, which may be obtained with a design of the frangible structure having a thinner middle portion in the circumferential direction of the closure.

According to another variant which has not been shown in the figures, the or each protruding element of the closure may be secured to the tamper-evident member 24, instead of the inner cap 4, and moved into abutting contact with the top wall 43 of the inner cap 4 upon application of an axial pushing force F on the outer cap 2 so as to break the frangible structure 26. In this case, the protruding element(s) secured to the tamper-evident member 24 may also form male coupling element(s) of the third engagement mechanism, configured to cooperate with corresponding female coupling element(s) provided on the inner cap 4.

As mentioned previously, a container with a closure according to the invention may also be different from the container 10 shown in the figures, in particular the container may have other shapes, possibly with non-rotational geometries, as long as it is provided with an opening which is provided, either externally as shown in the figures or internally, with an annular container thread on which the closure can be screwed. As readily understood, when the container thread is arranged internally, i.e. on the inner surface of the container opening, the cap thread is advantageously provided on an outer surface of an annular wall of the inner cap configured to be received inside the container opening.

Of course, many other variants can be considered, falling within the scope of the appended claims.

The invention claimed is:

1. A tamper-evident closure for a container having an opening with a container thread, the closure comprising:

an outer cap with a first sidewall and a first top wall, the first top wall comprising a tamper-evident member connected to a surrounding region by a frangible structure;

an inner cap with a second sidewall and a second top wall, the inner cap further comprising a cap thread configured to cooperate with the container thread, the inner cap coaxially nested in the outer cap so as to allow relative axial movement between the inner cap and the outer cap so that the first and second top walls can be displaced relative to each other, in a direction of a main axis of the closure;

at least one protruding element arranged between the first top wall and the second top wall while facing the tamper-evident member;

a first engagement mechanism between the outer cap and the inner cap, configured to drive the outer cap and the inner cap in unison in a direction of screwing the cap thread onto the container thread, upon application on the outer cap of a rotational torque in the direction of screwing, to mount the closure on the container without breaking the frangible structure;

a second engagement mechanism between the outer cap and the inner cap, configured to drive the outer cap and the inner cap in unison in a direction of unscrewing the cap thread relative to the container thread, upon application on the outer cap of a rotational torque in the direction of unscrewing at the same time as an axial force in the direction of the main axis, to remove the closure from the container;

wherein the closure further comprises a third engagement mechanism between the outer cap and the inner cap, configured to break the frangible structure upon relative rotational movement of the outer and inner caps when the outer cap is rotated in the direction of unscrewing, even in the absence of an axial force applied on the outer cap in the direction of the main axis.

2. The tamper-evident closure according to claim 1, comprising at least one elastic element, wherein the second engagement mechanism comprises coupling elements which are configured to be brought into mutual engagement by the axial force in such a way that the coupling elements of the second engagement mechanism are automatically disengaged by the at least one elastic element when the axial force is released.

3. The tamper-evident closure according to claim 2, wherein the at least one elastic element is configured to automatically disengage the coupling elements of the second engagement mechanism when the frangible structure is broken.

4. The tamper-evident closure according to claim 2, comprising at least one elastic member provided between the outer cap and the inner cap, for biasing the first and second top walls away from each other in the direction of the main axis, the coupling elements of the second engagement mechanism being brought in mutual engagement against an elastic action of the at least one elastic member.

5. The tamper-evident closure according to claim 2, wherein the outer cap is elastically deformable, the coupling elements of the second engagement mechanism being brought in mutual engagement by reversible elastic deformation of the outer cap.

6. The tamper-evident closure according to claim 1, wherein the third engagement mechanism comprises a first coupling element on the tamper-evident member and a second coupling element on the inner cap, the first coupling element having an engaging edge configured to cooperate with a corresponding engaging edge of the second coupling element upon relative rotational movement of the outer and inner caps when the outer cap is rotated in the direction of unscrewing.

7. The tamper-evident closure according to claim 6, wherein the engaging edge of the second coupling element provided on the inner cap is an inclined edge, on which the first coupling element provided on the tamper-evident member is configured to move away from the surrounding region in the direction of the main axis, upon relative rotational movement of the outer and inner caps when the outer cap is rotated in the direction of unscrewing.

8. The tamper-evident closure according to claim 6, wherein the engaging edge of the second coupling element provided on the inner cap is a substantially straight edge, against which the first coupling element provided on the tamper-evident member is configured to press circumferentially, upon relative rotational movement of the outer and inner caps when the outer cap is rotated in the direction of unscrewing.

9. The tamper-evident closure according to claim 1, wherein the at least one protruding element(s) is configured to break the frangible structure by coming in abutting contact with the tamper-evident member upon axial displacement of the first and second top walls toward each other in the direction of the main axis.

10. The tamper-evident closure according to claim 1, wherein the third engagement mechanism comprises at least one pair of male and female coupling elements including a coupling element on the tamper-evident member and a coupling element on the inner cap, the male coupling element being receivable in the female coupling element and axially moveable toward the female coupling element in the direction of the main axis, starting from an initial mounting configuration of the closure on the container.

11. The tamper-evident closure according to claim 1, wherein the third engagement mechanism comprises at least one pair of coupling elements including a male coupling element arranged on the tamper-evident member and a female coupling element arranged on the inner cap.

12. The tamper-evident closure according to claim 1, wherein the third engagement mechanism comprises at least one pair of coupling elements including a male coupling element arranged on the inner cap and a female coupling element arranged on the tamper-evident member.

13. The tamper-evident closure according to claim 1, wherein the first engagement mechanism comprises coupling elements, wherein the coupling elements of the first engagement mechanism comprise a plurality of elastic elements in a shape of inclined strips and a plurality of wedge-shaped elements, wherein, when a rotational torque in the direction of screwing is applied on the outer cap, the elastic elements come into a locking arrangement with the wedge-shaped elements so that the inner cap is rotated in unison with the outer cap in the direction of screwing.

14. The tamper-evident closure according to claim 1, wherein the third engagement mechanism comprises at least one pair of coupling elements including a coupling element on the tamper-evident member and a coupling element on the inner cap, wherein the frangible structure comprises a plurality of frangible bridges, each coupling element of the third engagement mechanism arranged on the tamper-evident member being positioned in a vicinity of a frangible bridge.

15. The tamper-evident closure according to claim 1, wherein each of the first engagement mechanism and the third engagement mechanism comprises coupling elements, wherein, in an initial mounting configuration of the closure, an angular stroke in the direction of screwing for engagement of the coupling elements of the first engagement mechanism is less than or equal to an angular stroke in the direction of screwing for engagement of the coupling elements of the third engagement mechanism.

16. The tamper-evident closure according to claim 1, wherein the second engagement mechanism comprises coupling elements, wherein an axial clearance of the closure in the direction of the main axis, corresponding to an axial displacement of the outer cap toward the inner cap between an initial mounting configuration of the closure and a configuration of the closure where the coupling elements of the second engagement mechanism start to be in mutual engagement, is higher than or equal to an axial displacement needed for the at least one protruding element to come into abutting contact with the tamper-evident member and break the frangible structure.

17. The tamper-evident closure according to claim 1, further comprising an indexing mechanism for positioning the outer cap and the inner cap in an initial mounting configuration of the closure, the indexing mechanism comprising complementary structures in relief on the outer cap and the inner cap adapted to guide the outer cap and the inner cap toward the initial mounting configuration of the closure while leaving the outer cap and the inner cap freely rotatable relative to each other in the initial mounting configuration of the closure.

18. The tamper-evident closure according to claim 1, wherein the inner cap defines a cavity for receiving an active material capable of regulating the atmosphere in a container equipped with the closure.

19. The tamper-evident closure according to claim 1, wherein the inner cap further comprises a sealing member configured to provide a hermetic seal between the inner cap and the container opening.

20. A container with a closure according to claim 1, wherein the closure is fixedly screwed onto a thread of the container and closing same.

* * * * *